US010851806B2

(12) United States Patent
Asahara et al.

(10) Patent No.: US 10,851,806 B2
(45) Date of Patent: Dec. 1, 2020

(54) PRESSURE BOOSTER

(71) Applicant: SMC CORPORATION, Chiyoda-ku (JP)

(72) Inventors: Hiroyuki Asahara, Tsukuba (JP); Kengo Monden, Ushiku (JP); Naoki Shinjo, Nagareyama (JP); Seiichi Nagura, Moriya (JP); Kazutaka Someya, Kashiwa (JP)

(73) Assignee: SMC CORPORATION, Chiyoda-ku (JP)

( * ) Notice: Subject to any disclaimer, the term of this patent is extended or adjusted under 35 U.S.C. 154(b) by 21 days.

(21) Appl. No.: 16/462,596

(22) PCT Filed: Aug. 17, 2017

(86) PCT No.: PCT/JP2017/029506
§ 371 (c)(1),
(2) Date: May 21, 2019

(87) PCT Pub. No.: WO2018/096739
PCT Pub. Date: May 31, 2018

(65) Prior Publication Data

US 2020/0063760 A1 Feb. 27, 2020

(30) Foreign Application Priority Data

Nov. 22, 2016 (JP) ..... 2016-226988

(51) Int. Cl.
*F15B 3/00* (2006.01)
*F15B 15/28* (2006.01)
(Continued)

(52) U.S. Cl.
CPC ..... *F15B 3/00* (2013.01); *F15B 9/09* (2013.01); *F15B 9/16* (2013.01); *F15B 13/086* (2013.01);
(Continued)

(58) Field of Classification Search
CPC ..... F15B 3/00; F15B 11/0365; F15B 9/08; F15B 9/09; F15B 9/16; F15B 15/28; F15B 2013/0409; F15B 13/086; F15B 15/2807
See application file for complete search history.

(56) References Cited

U.S. PATENT DOCUMENTS 9,695,840 B2 * 7/2017 Rabhi ..... F15B 3/00
9,926,947 B2 * 3/2018 Villar ..... F15B 3/00

FOREIGN PATENT DOCUMENTS

CN 202707647 U 1/2013
CN 105757015 A 7/2016
(Continued)

OTHER PUBLICATIONS

Combined Chinese Office Action and Search Report dated Mar. 20, 2020 in Chinese Patent Application No. 201780072318.2 (with English translation and English translation of Category of Cited Documents), 17 pages
(Continued)

*Primary Examiner* — Michael Leslie
(74) *Attorney, Agent, or Firm* — Oblon, McClelland, Maier & Neustadt, L.L.P.

(57) ABSTRACT

When a fluid is supplied to a first pressure-boosting chamber and/or a second pressure-boosting chamber of a pressure booster, either a first electromagnetic valve unit supplies a fluid discharged from a first pressurizing chamber to a second pressurizing chamber, or a second electromagnetic valve unit supplies a fluid discharged from a third pressurizing chamber to a fourth pressurizing chamber.

18 Claims, 16 Drawing Sheets

(51) Int. Cl.

| | |
|---|---|
| ***F15B 13/08*** | (2006.01) |
| ***F15B 9/09*** | (2006.01) |
| ***F15B 9/16*** | (2006.01) |

(52) U.S. Cl.
CPC ... *F15B 15/2807* (2013.01); *F15B 2211/3058* (2013.01); *F15B 2211/3133* (2013.01)

(56) References Cited

FOREIGN PATENT DOCUMENTS

| | | | |
|---|---|---|---|
| JP | 4-106502 | U | 9/1992 |
| JP | 8-21404 | A | 1/1996 |
| JP | 9-158901 | A | 6/1997 |
| JP | 2001-311404 | A | 11/2001 |
| JP | 2003-13904 | A | 1/2003 |
| JP | 2006-161857 | A | 6/2006 |
| JP | 2013-67259 | A | 4/2013 |
| JP | 2016-79999 | A | 5/2016 |

OTHER PUBLICATIONS

International Search Report dated Sep. 19, 2017 in PCT/JP2017/029506 filed on Aug. 17, 2017.

* cited by examiner

10A

10A

PRESSURE BOOSTER

TECHNICAL FIELD

The present invention relates to a pressure booster adapted to increase the pressure of a fluid.

BACKGROUND ART

With the object of supplying a high pressure fluid to a fluid pressure apparatus, a pressure booster, which increases the pressure of a supplied fluid, and outputs the fluid after having been boosted in pressure to the exterior, has been disclosed, for example, in Japanese Laid-Open Patent Publication No. 08-021404 and Japanese Laid-Open Patent Publication No. 09-158901.

In FIG. 1 of Japanese Laid-Open Patent Publication No. 08-021404, it is disclosed that a piston rod penetrates through three chambers formed in the pressure booster, and in each of the chambers, by pistons being connected to the piston rod, a central chamber is partitioned into two drive chambers, and each of chambers on both left and right sides of the central chamber is partitioned into a compression chamber on an inner side and an operating chamber on an outer side. In this case, when air is supplied to the two compression chambers and the operating chamber on the left end, the operating chamber on the right end and the drive chamber on the left side are placed in communication, and the air is discharged from the drive chamber on the right side, the pistons are displaced in a rightward direction, and the air in the left side compression chamber is boosted in pressure and output to the exterior. On the other hand, when air is supplied to the two compression chambers and the operating chamber on the right end, the operating chamber on the left end and the drive chamber on the right side are placed in communication, and the air is discharged from the drive chamber on the left side, the pistons are displaced in a leftward direction, and the air in the right side compression chamber is boosted in pressure and output to the exterior.

In FIGS. 1 and 2 of Japanese Laid-Open Patent Publication No. 09-158901, it is disclosed that a piston rod penetrates through two cylinder chambers formed in the pressure booster, and in each of the cylinder chambers, by pistons being connected to the piston rod, a first cylinder chamber on a right side is partitioned into an inner side first fluid chamber and an outer side second fluid chamber, and a second cylinder chamber on a left side is partitioned into an outer side third fluid chamber and an inner side fourth fluid chamber. In this case, a compression spring is interposed between a cover member provided between the first cylinder chamber and the second cylinder chamber, and a second piston inside the second cylinder chamber. In this instance, when the first fluid chamber and the third fluid chamber are filled with compressed air, a driving force of the compressed air overcomes a driving force of the compression spring, and the first piston and the second piston move to the right. On the other hand, when the compressed air is discharged from the first fluid chamber and the third fluid chamber, the first piston and the second piston move in a leftward direction by the driving force of the compression spring.

SUMMARY OF INVENTION

In the conventional pressure boosters, an adjustment mechanism for adjusting a pressure value of the fluid to be boosted in pressure is integrated with the pressure booster, and therefore, depending on a set value, there is a concern that, if the pressure value becomes equalized between a pressurizing chamber in which a piston is pressed by supply of the fluid, and a drive chamber that is compressed by movement of the piston, and more specifically, between chambers on both sides of the piston, i.e., sandwiching the piston, the piston will be stopped from moving. Thus, conventionally, as disclosed in Japanese Laid-Open Patent Publication No. 09-158901, a mechanism for forcibly displacing the piston by a compression spring or the like, and a countermeasure of providing a groove to allow the fluid inside the pressurizing chamber to escape so as to generate a pressure difference have been adopted. As a result, there has been a problem in that the adjustment mechanism inside the pressure booster is of a complicated structure.

The present invention has been devised in order to solve the aforementioned problems, and has the object of providing a pressure booster in which, with a simple structure, and by displacing the pistons without balancing of the pressure values, a fluid that is supplied thereto can easily be boosted in pressure, together with achieving a savings in energy (energy conservation) of the device as a whole.

The pressure booster according to the present invention includes a pressure boosting chamber, a first drive chamber disposed on one end side of the pressure boosting chamber, and a second drive chamber disposed on another end side of the pressure boosting chamber. In this case, a piston rod penetrates through the pressure boosting chamber and extends to the first drive chamber and the second drive chamber.

By a pressure boosting piston being connected to the piston rod inside the pressure boosting chamber, the pressure boosting chamber is partitioned into a first pressure boosting chamber on a side of the first drive chamber, and a second pressure boosting chamber on a side of the second drive chamber. Further, by a first drive piston being connected to one end of the piston rod inside the first drive chamber, the first drive chamber is partitioned into a first pressurizing chamber on a side of the first pressure boosting chamber, and a second pressurizing chamber remote from the first pressure boosting chamber. Further, by a second drive piston being connected to another end of the piston rod inside the second drive chamber, the second drive chamber is partitioned into a third pressurizing chamber on a side of the second pressure boosting chamber, and a fourth pressurizing chamber remote from the second pressure boosting chamber.

In addition, the pressure booster further includes a fluid supplying mechanism adapted to supply a fluid to at least one of the first pressure boosting chamber and the second pressure boosting chamber, a first discharge return mechanism adapted to supply the fluid discharged from the first pressurizing chamber to the second pressurizing chamber, or to supply the fluid discharged from the second pressurizing chamber to the first pressurizing chamber, and a second discharge return mechanism adapted to supply the fluid discharged from the third pressurizing chamber to the fourth pressurizing chamber, or to supply the fluid discharged from the fourth pressurizing chamber to the third pressurizing chamber.

As described above, the pressure booster has a three-stage cylinder structure in which the first drive chamber, the pressure boosting chamber, and the second drive chamber are formed sequentially along the piston rod. In this case, when the fluid is supplied from the fluid supplying mechanism to at least one of the first pressure boosting chamber and the second pressure boosting chamber, in the first drive chamber and the second drive chamber on the outer sides, in accordance with operation of the first discharge return mechanism or the second discharge return mechanism, by supplying the fluid discharged from one of the pressurizing chambers to the other pressurizing chamber, the first drive piston, the pressure boosting piston, and the second drive piston can be made to undergo movement.

More specifically, in the case that the fluid flows into the second pressurizing chamber and the first drive piston is pressed toward the side of the first pressurizing chamber, or in the case that the fluid flows into the third pressurizing chamber and the second drive piston is pressed toward the side of the fourth pressurizing chamber, the first drive piston, the pressure boosting piston and the second drive piston can be made to move to the side of the second drive chamber. As a result, the fluid inside the second pressure boosting chamber can be boosted in pressure.

On the other hand, in the case that the fluid flows into the first pressurizing chamber and the first drive piston is pressed toward the side of the second pressurizing chamber, or in the case that the fluid flows into the fourth pressurizing chamber and the second drive piston is pressed toward the side of the third pressurizing chamber, the first drive piston, the pressure boosting piston and the second drive piston can be made to move to the side of the first drive chamber. As a result, the fluid inside the first pressure boosting chamber can be boosted in pressure.

In either of these cases, in the pressure booster, the fluid supplied from the exterior via the fluid supplying mechanism is used in order to boost the pressure inside the centrally located first pressure boosting chamber or second pressure boosting chamber. Further, movement of the first drive piston, the pressure boosting piston, and the second drive piston is caused and carried out by movement of the discharge fluid between the pressurizing chambers in accordance with operation of the first discharge return mechanism and the second discharge return mechanism.

Consequently, according to the present invention, with a simple structure, the fluid supplied to the first pressure boosting chamber or the second pressure boosting chamber can easily be boosted in pressure by displacing the respective pistons without causing the pressure values on both sides of the respective pistons to be balanced.

Further, in the pressure booster, movement of the discharged fluid between the pressurizing chambers as performed by the first discharge return mechanism and the second discharge return mechanism is carried out alternately, and by the first drive piston, the pressure boosting piston, and the second drive piston being moved reciprocally, the fluid supplied to the first pressure boosting chamber and the second pressure boosting chamber can be alternately boosted in pressure, and the fluid after having been boosted in pressure can be output to the exterior. Consequently, the pressure of the fluid supplied from the exterior to the first pressure boosting chamber or the second pressure boosting chamber via the fluid supplying mechanism can be boosted to a pressure value up to three times that of the original pressure at a maximum and output to the exterior.

However, depending on the specifications of the fluid pressure apparatus to which the fluid that was boosted in pressure is supplied, a pressure value less than three times, for example, a pressure value that is two times that of the original pressure may be sufficient. If the size of the pressure booster in a diametrical direction (a direction perpendicular to the piston rod) is set to be small corresponding to such specifications, the flow rate of the fluid supplied to the first pressure boosting chamber or the second pressure boosting chamber from the exterior via the fluid supplying mechanism becomes smaller, and it is possible to easily output to the exterior a fluid of a pressure value that is two times that of the original pressure. Consequently, in comparison with a conventional pressure booster, consumption of the supplied fluid can be reduced, and energy conservation of the pressure booster can be realized. Further, by specifying the pressure value to be two times that of the original pressure, since a surplus in the capacity of the pressure boosting operation of the pressure booster can be realized, it is possible to prolong the service life of the pressure booster.

In the foregoing manner, since it is possible to reduce the size and scale of the device, the pressure booster can be suitably adopted for use with automated assembly equipment for which it is necessary to limit the weight of the cylinder accompanying a reduction in the weight and size of the equipment.

In this instance, in the pressure booster, in the case that the fluid is supplied from the fluid supplying mechanism to the first pressure boosting chamber, at least one of the following situations may occur. Namely, the first discharge return mechanism may supply the fluid discharged from the first pressurizing chamber to the second pressurizing chamber, or the second discharge return mechanism may supply the fluid discharged from the fourth pressurizing chamber to the third pressurizing chamber. On the other hand, in the case that the fluid is supplied from the fluid supplying mechanism to the second pressure boosting chamber, at least one of the following situations may occur. Namely, the second discharge return mechanism may supply the fluid discharged from the third pressurizing chamber to the fourth pressurizing chamber, or the first discharge return mechanism may supply the fluid discharged from the second pressurizing chamber to the first pressurizing chamber.

In accordance with this feature, when the first drive piston, the pressure boosting piston, and the second drive piston undergo reciprocal movement, the fluid supplied to one of the pressurizing chambers during movement in one direction can be supplied to the other pressurizing chamber during movement in the other direction. That is, according to the present invention, by the fluid discharged from one of the pressurizing chambers being recovered and supplied to the other pressurizing chamber, the fluid is utilized again. Consequently, in comparison with a situation, as in the conventional technique, in which fluid is discharged from the pressurizing chambers each time that the pistons move, the fluid supplied to the first pressurizing chamber and the second pressurizing chamber can be boosted in pressure while the amount of fluid consumption in the pressure booster as a whole is reduced.

Additionally, in the present invention, the first discharge return mechanism and the second discharge return mechanism are differentiated by the following three fluid supplying methods, as described below.

Initially, a first fluid supplying method is defined by a fluid supplying method in which there is used a difference in the pressure receiving areas on both sides of the first drive piston and the second drive piston.

More specifically, in the pressure booster, in the case that the fluid is supplied from the fluid supplying mechanism to the first pressure boosting chamber, the first discharge return mechanism may supply the fluid discharged from the first pressurizing chamber to the second pressurizing chamber, based on a difference, on the first drive piston, between a pressure receiving area on the side of the first pressurizing chamber and a pressure receiving area on the side of the second pressurizing chamber, and the second discharge return mechanism may supply the fluid to the third pressurizing chamber together with discharging the fluid from the fourth pressurizing chamber. On the one hand, in the case that the fluid is supplied from the fluid supplying mechanism to the second pressure boosting chamber, the first discharge return mechanism may supply the fluid to the first pressurizing chamber together with discharging the fluid from the second pressurizing chamber, and the second discharge return mechanism may supply the fluid discharged from the third pressurizing chamber to the fourth pressurizing chamber, based on a difference, on the second drive piston, between a pressure receiving area on the side of the third pressurizing chamber and a pressure receiving area on the side of the fourth pressurizing chamber.

More specifically, when the first pressurizing chamber and the second pressurizing chamber are compared, because the piston rod is present in the first pressurizing chamber, the pressure receiving area thereof is reduced. Accordingly, the fluid discharged from the first pressurizing chamber moves smoothly into the second pressurizing chamber due to a pressure difference caused by the difference in the pressure receiving areas between the first pressurizing chamber and the second pressurizing chamber. Consequently, by the fluid that has flowed into the second pressurizing chamber, the first drive piston is pressed toward the side of the first pressurizing chamber, and therefore, the first drive piston, the pressure boosting piston, and the second drive piston can be moved to the side of the second drive chamber. As a result, the fluid supplied to the second pressure boosting chamber can be easily boosted in pressure.

On the other hand, in the same manner as the case of the first pressurizing chamber and the second pressurizing chamber, when the third pressurizing chamber and the fourth pressurizing chamber are compared, because the piston rod is present in the third pressurizing chamber, the pressure receiving area thereof is reduced. Accordingly, the fluid discharged from the third pressurizing chamber moves smoothly into the fourth pressurizing chamber due to a pressure difference caused by the difference in the pressure receiving areas between the third pressurizing chamber and the fourth pressurizing chamber. Consequently, by the fluid that has flowed into the fourth pressurizing chamber, the second drive piston is pressed toward the side of the third pressurizing chamber, and therefore, the first drive piston, the pressure boosting piston, and the second drive piston can be moved to the side of the first drive chamber. As a result, the fluid supplied to the first pressure boosting chamber can be easily boosted in pressure.

In this case, the first discharge return mechanism is configured to include a solenoid valve which is adapted to supply the fluid supplied from the exterior to the fluid supplying mechanism to the first pressurizing chamber together with discharging the fluid of the second pressurizing chamber to the exterior, and on the other hand, is adapted to supply the fluid discharged from the first pressurizing chamber to the second pressurizing chamber. Further, the second discharge return mechanism is configured to include a solenoid valve which is adapted to supply the fluid supplied from the exterior to the fluid supplying mechanism to the third pressurizing chamber together with discharging the fluid of the fourth pressurizing chamber to the exterior, and on the other hand, is adapted to supply the fluid discharged from the third pressurizing chamber to the fourth pressurizing chamber.

In accordance with this feature, based on the supply of a control signal from the exterior to the solenoid valve, it is possible to reliably switch between operations of supplying and discharging the fluid, and an operation of supplying the discharged fluid.

More specifically, the first discharge return mechanism is configured to include a first solenoid valve connected to the first pressurizing chamber, a second solenoid valve connected to the second pressurizing chamber, and a first discharge return flow passage connected with the first solenoid valve and the second solenoid valve. In this case, at a first position of the first solenoid valve and the second solenoid valve, the first pressurizing chamber and the second pressurizing chamber communicate with each other through the first discharge return flow passage. On the other hand, at a second position of the first solenoid valve and the second solenoid valve, the first pressurizing chamber communicates with the fluid supplying mechanism, and the second pressurizing chamber communicates with the exterior.

Further, the second discharge return mechanism is configured to include a third solenoid valve connected to the third pressurizing chamber, a fourth solenoid valve connected to the fourth pressurizing chamber, and a second discharge return flow passage connected with the third solenoid valve and the fourth solenoid valve. In this case, at a first position of the third solenoid valve and the fourth solenoid valve, the third pressurizing chamber and the fourth pressurizing chamber communicate with each other through the second discharge return flow passage. On the other hand, at a second position of the third solenoid valve and the fourth solenoid valve, the third pressurizing chamber communicates with the fluid supplying mechanism, and the fourth pressurizing chamber communicates with the exterior.

In accordance with this feature, based on the supply of control signals from the exterior to the first to fourth solenoid valves, it is possible to efficiently carry out the operations of supplying and discharging the fluid, or the operation of supplying the discharged fluid.

Next, a second fluid supplying method is defined by a fluid supplying method in which, in the first drive chamber and the second drive chamber, it is possible to alternately carry out a case of supplying the fluid accumulated in the one pressurizing chamber to the other pressurizing chamber, and a case of supplying the fluid accumulated in the other pressurizing chamber to the one pressurizing chamber.

More specifically, in the pressure booster, in the case that the fluid is supplied from the fluid supplying mechanism to the first pressure boosting chamber, the first discharge return mechanism supplies the fluid discharged from the first pressurizing chamber to the second pressurizing chamber, together with the second discharge return mechanism supplying the fluid discharged from the fourth pressurizing chamber to the third pressurizing chamber. On the other hand, in the case that the fluid is supplied from the fluid supplying mechanism to the second pressure boosting chamber, the first discharge return mechanism supplies the fluid discharged from the second pressurizing chamber to the first pressurizing chamber, together with the second discharge return mechanism supplying the fluid discharged from the third pressurizing chamber to the fourth pressurizing chamber.

In accordance with such a configuration, in the case that the fluid accumulated in the one pressurizing chamber is supplied to the other pressurizing chamber, or in the case that the fluid accumulated in the other pressurizing chamber is supplied to the one pressurizing chamber, the first drive piston, the pressure boosting piston, and the second drive piston can be smoothly moved, and the service life of the pressure booster can be prolonged.

More specifically, the first discharge return mechanism is configured to include a three-way valve type fifth solenoid valve which, in a first position, is adapted to interrupt communication between the first pressurizing chamber and the second pressurizing chamber, whereas in a second position, is adapted to allow communication between the first pressurizing chamber and the second pressurizing chamber. In this case, the fifth solenoid valve, by switching between a communication interrupted state and a communication allowed state, carries out supply of the fluid discharged from the first pressurizing chamber to the second pressurizing chamber, or carries out supply of the fluid discharged from the second pressurizing chamber to the first pressurizing chamber.

Further, the second discharge return mechanism is configured to include a three-way valve type sixth solenoid valve which, in a first position, is adapted to allow communication between the third pressurizing chamber and the fourth pressurizing chamber, whereas in a second position, is adapted to interrupt communication between the third pressurizing chamber and the fourth pressurizing chamber. In this case, the sixth solenoid valve, by switching between a communication interrupted state and a communication allowed state, carries out supply of the fluid discharged from the third pressurizing chamber to the fourth pressurizing chamber, or carries out supply of the fluid discharged from the fourth pressurizing chamber to the third pressurizing chamber.

In accordance with these features, since the operation of supplying the discharged fluid can be reliably switched based on the supply of control signals from the exterior to the fifth solenoid valve and the sixth solenoid valve, the first drive piston, the pressure boosting piston, and the second drive piston can be moved smoothly, and it is possible to easily realize a lengthening of the service life of the pressure booster.

Next, a third fluid supplying method is defined by a fluid supplying method in which, in the first drive chamber and the second drive chamber, the fluid accumulated in one of the pressurizing chambers is supplied to the other pressurizing chamber together with discharging the fluid to the exterior.

More specifically, in the pressure booster, in the case that the fluid is supplied from the fluid supplying mechanism to the first pressure boosting chamber, the first discharge return mechanism discharges the fluid from the first pressurizing chamber together with supplying the fluid to the second pressurizing chamber, and the second discharge return mechanism, while supplying a portion of the fluid discharged from the fourth pressurizing chamber to the third pressurizing chamber, discharges another portion of the fluid to the exterior. On the other hand, in the case that the fluid is supplied from the fluid supplying mechanism to the second pressure boosting chamber, the first discharge return mechanism, while supplying a portion of the fluid discharged from the second pressurizing chamber to the first pressurizing chamber, discharges another portion of the fluid to the exterior, and the second discharge return mechanism discharges the fluid from the third pressurizing chamber together with supplying the fluid to the fourth pressurizing chamber.

In the foregoing manner, the fluid that is accumulated in one of the pressurizing chambers is supplied to the other pressurizing chamber together with being discharged to the exterior, and therefore, together with the pressure of the other pressurizing chamber being increased, the pressure of the one pressurizing chamber can be rapidly reduced. Consequently, the first drive piston, the pressure boosting piston, and the second drive piston can be made to move smoothly, and an increased service life of the pressure booster can be achieved.

In this case, the first discharge return mechanism is configured to include a seventh solenoid valve which is adapted to supply the fluid supplied from the exterior to the fluid supplying mechanism to the second pressurizing chamber together with discharging the fluid of the first pressurizing chamber to the exterior, and on the other hand, while supplying a portion of the fluid discharged from the second pressurizing chamber to the first pressurizing chamber, is adapted to discharge another portion of the fluid to the exterior. Further, the second discharge return mechanism is configured to include an eighth solenoid valve which is adapted to supply the fluid supplied from the exterior to the fluid supplying mechanism to the fourth pressurizing chamber together with discharging the fluid of the third pressurizing chamber to the exterior, and on the other hand, while supplying a portion of the fluid discharged from the fourth pressurizing chamber to the third pressurizing chamber, is adapted to discharge another portion of the fluid to the exterior.

In accordance with these features, since the operation of supplying and discharging the fluid, or the operation of supplying the discharged fluid can be reliably switched based on the supply of control signals from the exterior to the seventh solenoid valve and the eighth solenoid valve, the first drive piston, the pressure boosting piston, and the second drive piston can be moved smoothly, and it is possible to easily realize a lengthening of the service life of the pressure booster.

In addition, the first discharge return mechanism is configured to include a four-way five-port seventh solenoid valve, and a first check valve. In this case, the seventh solenoid valve, in a first position, places the first pressurizing chamber in communication with the exterior together with placing the second pressurizing chamber in communication with the fluid supplying mechanism, whereas in a second position, places the second pressurizing chamber in communication with the exterior and in communication with the first pressurizing chamber via the first check valve.

Further, the second discharge return mechanism is configured to include a four-way five-port eighth solenoid valve, and a second check valve. In this case, the eighth solenoid valve, in a first position, places the fourth pressurizing chamber in communication with the exterior and in communication with the third pressurizing chamber via the second check valve, whereas in a second position, places the third pressurizing chamber in communication with the exterior together with placing the fourth pressurizing chamber in communication with the fluid supplying mechanism.

In accordance with this feature, based on the supply of control signals from the exterior to the seventh solenoid valve and the eighth solenoid valve, it is possible to efficiently carry out the operations of supplying and discharging the fluid, or the operation of supplying the discharged fluid. Further, due to the simple circuit structure containing the first check valve and the second check valve, it is possible to simplify the configuration of the pressure booster as a whole.

Additionally, in the present invention, the pressure booster further includes a position detecting sensor adapted to detect the position of the first drive piston or the second drive piston. In this case, on the basis of the detection result of the position detecting sensor, the first discharge return mechanism and the second discharge return mechanism respectively supply the fluid discharged from one of the pressure boosting chambers to the other pressure boosting chamber. In accordance with this feature, an increase in pressure of the fluid supplied to the first pressure boosting chamber and the second pressure boosting chamber can be carried out efficiently.

Further, conventionally, operations of supplying and discharging the fluid are switched, as a result of knock pins being incorporated in the pressure booster, and the pistons being caused to abut against the knock pins. However, there is a problem in that sounds (hammering noises) which occur each time that the pistons move and abut against the knock pins produce noise, and the sounds (operating sounds) generated by the pressure booster during operation of the pistons is large. In contrast thereto, according to the present invention, as described above, since the fluid discharged from one of the pressurizing chambers is supplied to the other pressurizing chamber on the basis of the detection result of the position detecting sensor, the aforementioned knock pins are rendered unnecessary. As a result, noises generated upon movement of the first drive piston, the pressure boosting piston, and the second drive piston can be suppressed, and operating sounds of the pressure booster can be reduced.

In this case, the position detecting sensor may include a first position detecting sensor adapted to detect arrival of the first drive piston or the second drive piston at one end side of the first drive chamber or the second drive chamber, and a second position detecting sensor adapted to detect arrival of the first drive piston or the second drive piston at another end side of the first drive chamber or the second drive chamber.

In accordance with this feature, a directional control valve for driving the first drive piston, the pressure boosting piston, and the second drive piston is rendered unnecessary, and the internal structure of the pressure booster is simplified. As a result, it is possible to enhance the productivity of the pressure booster.

Further, the position detecting sensor may include a magnetic sensor adapted to detect the position of the first drive piston or the second drive piston by detecting magnetism produced by a magnet attached to the first drive piston or the second drive piston. Consequently, the position of the first drive piston or the second drive piston can be detected easily and accurately.

In addition, the pressure booster may further include a pressure sensor adapted to detect a pressure of the fluid discharged from one of the pressurizing chambers and supplied to the other pressurizing chamber. In accordance therewith, based on a detection result of the pressure sensor, the first discharge return mechanism and the second discharge return mechanism can respectively stop supplying the fluid discharged from the one of the pressurizing chambers to the other pressurizing chamber. Accordingly, even in the event that the pressure sensor is used, similar to the case of the position detecting sensor, an increase in pressure of the fluid supplied to the first pressure boosting chamber and the second pressure boosting chamber can be carried out efficiently.

Moreover, the fluid supplying mechanism may be configured to include a check valve that prevents back-flowing of fluid from the first pressure boosting chamber and the second pressure boosting chamber. Further, the pressure booster may further include a fluid output mechanism adapted to output to the exterior the fluid that was boosted in pressure in the first pressure boosting chamber or the second pressure boosting chamber, and the fluid output mechanism may be configured to include a check valve that prevents back-flowing of the fluid into the first pressure boosting chamber and the second pressure boosting chamber. In either of these cases, in the first pressure boosting chamber and the second pressure boosting chamber, the pressure can be reliably increased with respect to the supplied fluid.

Further, if a size in a diametrical direction of the first drive chamber and a size in a diametrical direction of the second drive chamber are made smaller than a size in a diametrical direction of the pressure boosting chamber, it is possible to realize a reduction in the size of the pressure booster as a whole. Further, by reducing the sizes of the first drive chamber and the second drive chamber, the flow rate of the fluid discharged from the first to fourth pressurizing chambers is reduced, and it is possible suppress noise that is generated at the time of discharge.

Furthermore, in the pressure booster, a first cover member is interposed between the first pressure boosting chamber and the first pressurizing chamber, a second cover member is interposed between the second pressure boosting chamber and the third pressurizing chamber, a third cover member is disposed on an end of the second pressurizing chamber remote from the first cover member, and a fourth cover member is disposed on an end of the fourth pressurizing chamber remote from the second cover member. In this case, the first drive piston is displaced inside the first drive chamber without coming into contact with the first cover member and the third cover member, the second drive piston is displaced inside the second drive chamber without coming into contact with the second cover member and the fourth cover member, and the pressure boosting piston is displaced inside the pressure boosting chamber without coming into contact with the first cover member and the second cover member.

In accordance with this feature, when the fluid is supplied to or discharged from the first to fourth pressurizing chambers, the first pressure boosting chamber, and the second pressure boosting chamber, the first drive piston, the pressure boosting piston, and the second drive piston are capable of being smoothly moved.

The above and other objects, features, and advantages of the present invention will become more apparent from the following description of a preferred exemplary embodiment when taken in conjunction with the accompanying drawings.

DESCRIPTION OF EMBODIMENTS

Figure 1:
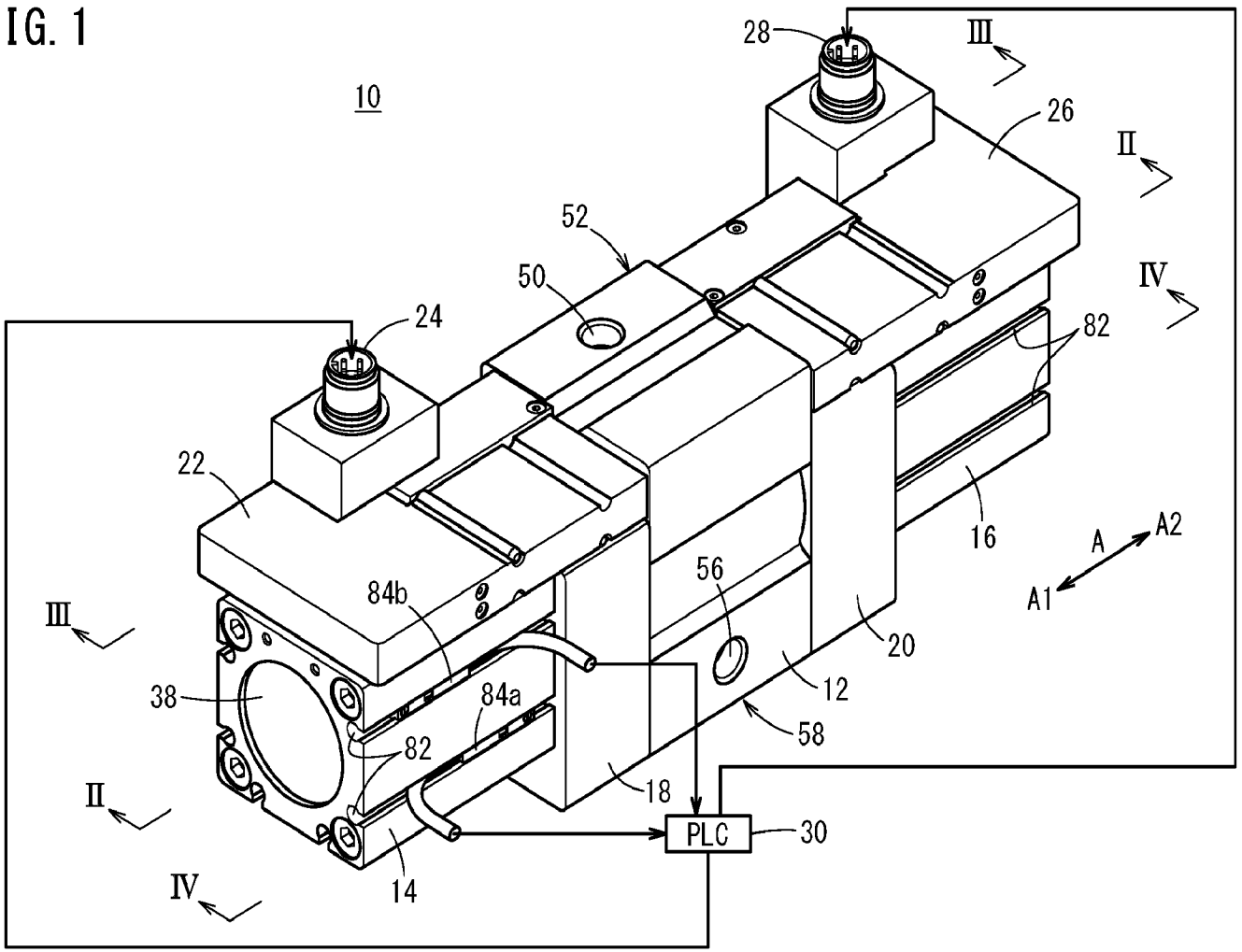
FIG. 1 is a perspective view of a pressure booster according to a present embodiment.

A preferred embodiment of a pressure booster according to the present invention will be described in detail below with reference to the drawings.

[Configuration of Present Embodiment]

As shown in FIGS. 1 to 5, a pressure booster 10 according to the present embodiment includes a three-stage cylinder structure in which a first drive cylinder 14 is disposed contiguously on one end side (a side in the A1 direction) of a pressure boosting cylinder 12, and a second drive cylinder 16 is disposed contiguously on another end side (a side in the A2 direction) of the pressure boosting cylinder 12. Accordingly, in the pressure booster 10, the first drive cylinder 14, the pressure boosting cylinder 12, and the second drive cylinder 16 are disposed contiguously in this order from the A1 direction toward the A2 direction. A block-shaped first cover member 18 is interposed between the first drive cylinder 14 and the pressure boosting cylinder 12, whereas a block-shaped second cover member 20 is interposed between the pressure boosting cylinder 12 and the second drive cylinder 16. Moreover, the pressure boosting cylinder 12 projects in upper and lower directions more so than the first drive cylinder 14 and the second drive cylinder 16.

A block-shaped first solenoid valve unit 22 (first discharge return mechanism) is disposed on an upper surface of the first drive cylinder 14 and the first cover member 18, and a first connector 24 is disposed on an upper surface of the first solenoid valve unit 22. On the other hand, a block-shaped second solenoid valve unit 26 (second discharge return mechanism) is disposed on an upper surface of the second drive cylinder 16 and the second cover member 20, and a second connector 28 is disposed on an upper surface of the second solenoid valve unit 26. The first connector 24 and the second connector 28 are connected to a PLC (Programmable Logic Controller) 30, which is a higher order control device with respect to the pressure booster 10.

Figure 2:
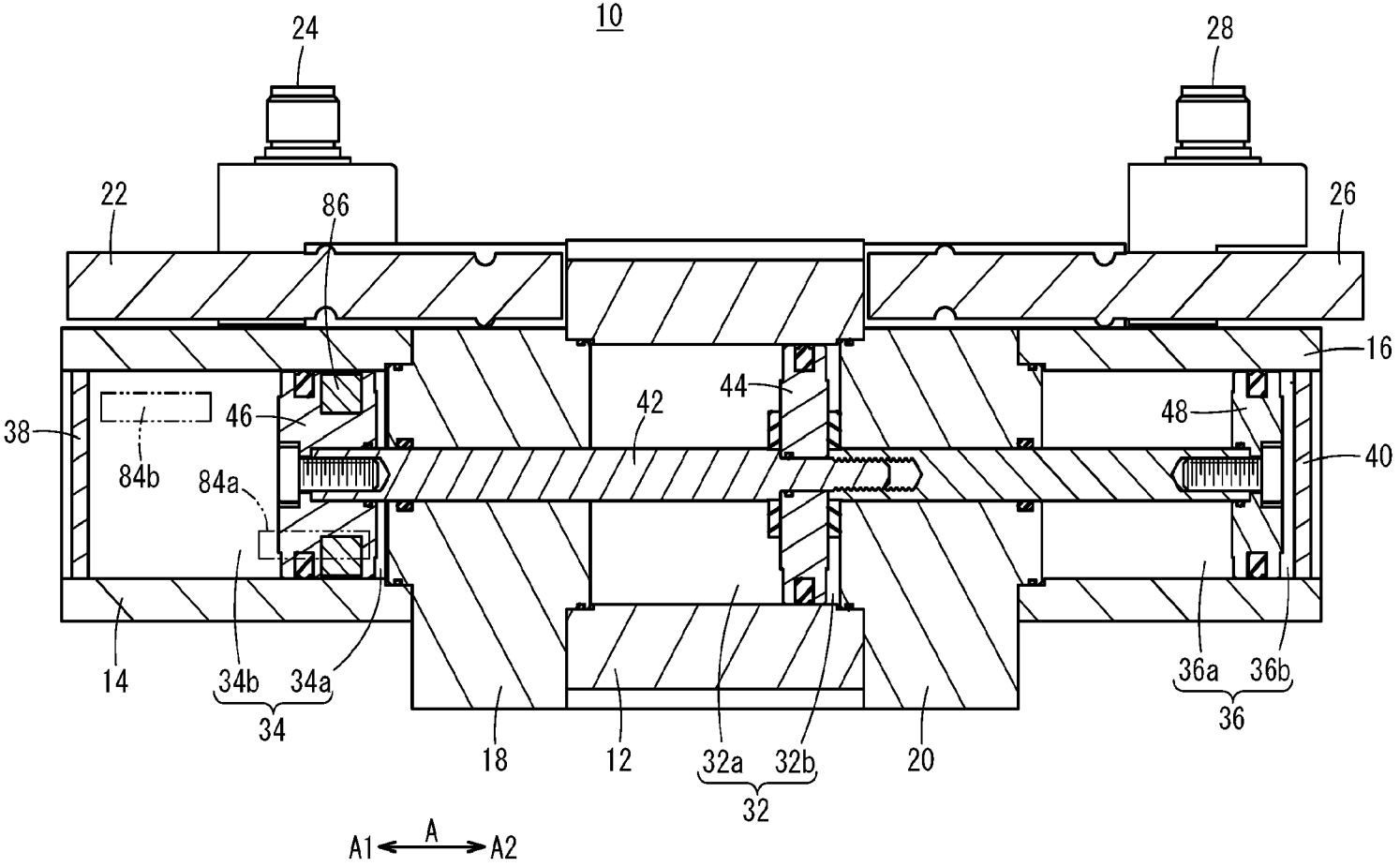
FIG. 2 is a cross-sectional view taken along line II-II of FIG. 1.
Figure 3:
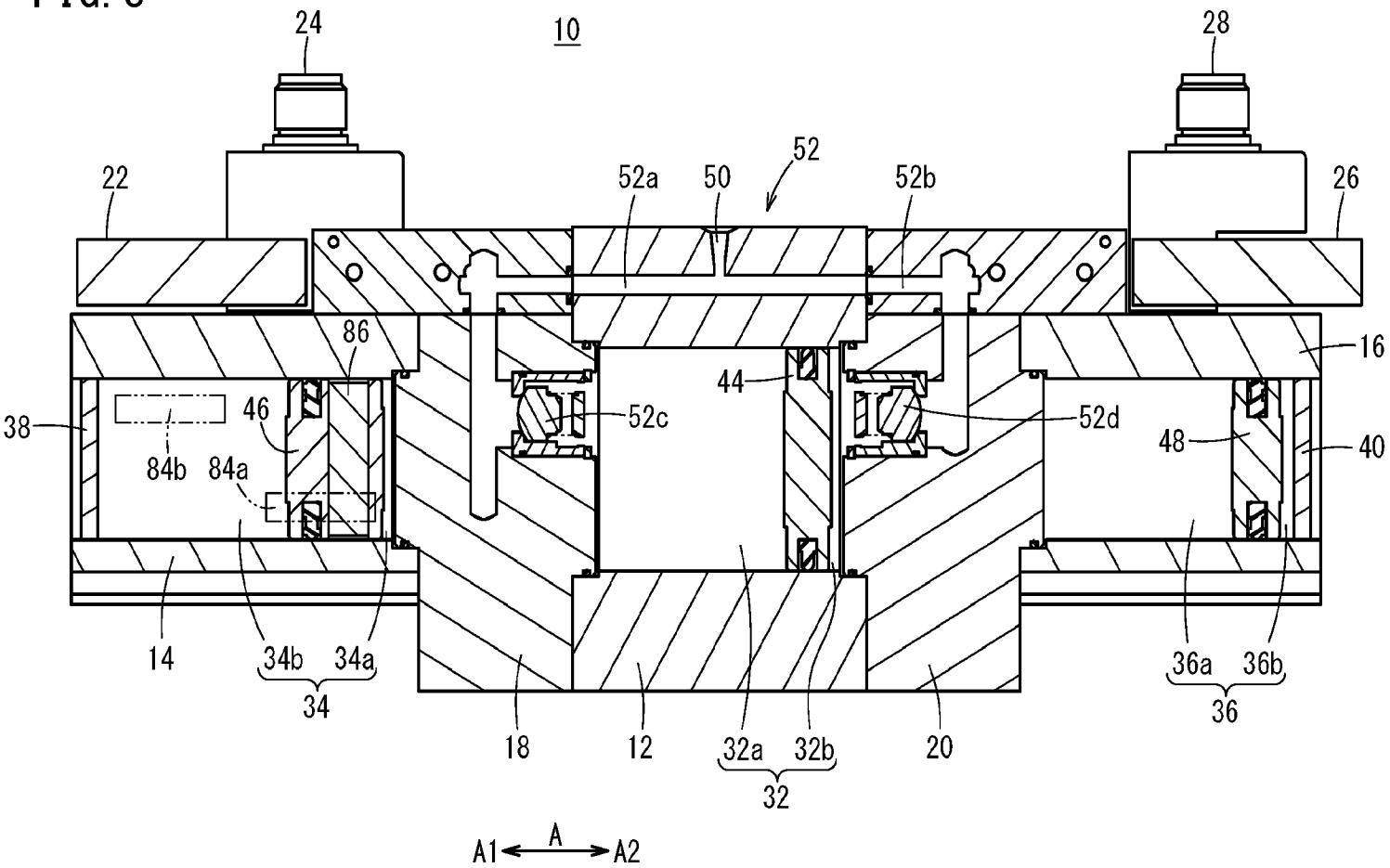
FIG. 3 is a cross-sectional view taken along line III-III of FIG. 1.
Figure 4:
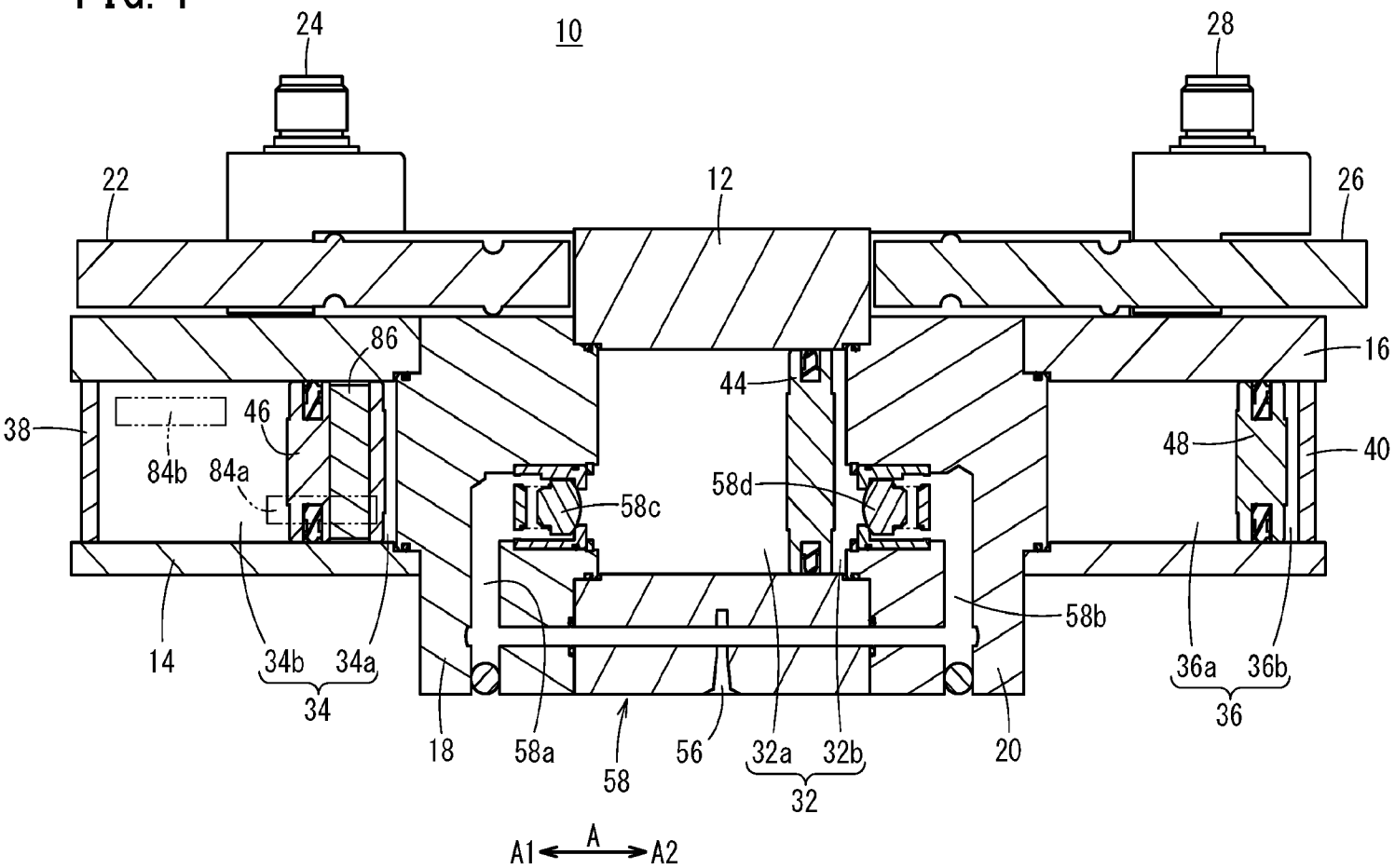
FIG. 4 is a cross-sectional view taken along line IV-IV of FIG. 1.

As shown in FIGS. 2 to 4, a pressure boosting chamber 32 is formed inside the pressure boosting cylinder 12. Further, a first drive chamber 34 is formed inside the first drive cylinder 14. Furthermore, a second drive chamber 36 is formed inside the second drive cylinder 16. In this case, a third cover member 38 is fixed to an end of the first drive cylinder 14 in the A1 direction, and the first cover member 18 is disposed at an end in the A2 direction, thereby forming the first drive chamber 34. On the other hand, the second cover member 20 is disposed at an end of the second drive cylinder 16 in the A1 direction, and a fourth cover member 40 is fixed to an end in the A2 direction, thereby forming the second drive chamber 36. Moreover, the sizes of the first drive chamber 34 and the second drive chamber 36 in the diametrical direction (a direction perpendicular to the A directions) is smaller than the size of the pressure boosting chamber 32 in the diametrical direction.

Additionally, in the interior of the pressure booster 10, a piston rod 42 penetrates through the first cover member 18, the pressure boosting chamber 32, and the second cover member 20 in the A directions, and extends to the first drive chamber 34 and the second drive chamber 36.

In the pressure boosting chamber 32, a pressure boosting piston 44 is connected to the piston rod 42. Consequently, the pressure boosting chamber 32 is partitioned into a first pressure boosting chamber 32*a* on a side in the A1 direction, and a second pressure boosting chamber 32*b* on a side in the A2 direction. Moreover, the pressure boosting piston 44 is displaced inside the pressure boosting chamber 32 in the A directions without coming into contact with the first cover member 18 and the second cover member 20.

Further, in the first drive chamber 34, a first drive piston 46 is connected to one end of the piston rod 42 in the A1 direction. Consequently, the first drive chamber 34 is partitioned into a first pressurizing chamber 34*a* on a side in the A2 direction, and a second pressurizing chamber 34*b* on a side in the A1 direction. Moreover, the first drive piston 46 is displaced inside the first drive chamber 34 in the A directions without coming into contact with the first cover member 18 and the third cover member 38.

Furthermore, in the second drive chamber 36, a second drive piston 48 is connected to another end of the piston rod 42 in the A2 direction. Consequently, the second drive chamber 36 is partitioned into a third pressurizing chamber 36*a* on a side in the A1 direction, and a fourth pressurizing chamber 36*b* on a side in the A2 direction. Moreover, the second drive piston 48 is displaced inside the second drive chamber 36 in the A directions without coming into contact with the second cover member 20 and the fourth cover member 40.

An inlet port 50 to which a fluid (for example, air) is supplied from a non-illustrated external fluid supply source is formed on an upper surface of the pressure boosting cylinder 12. In the pressure boosting cylinder 12, a fluid supplying mechanism 52 is provided, which communicates with the inlet port 50, and supplies the supplied fluid to at least one from among the first pressure boosting chamber 32*a* and the second pressure boosting chamber 32*b*.

The fluid supplying mechanism 52 is disposed on a rear surface portion on the pressure boosting cylinder 12, on the side of the first connector 24 and the second connector 28. The fluid supplying mechanism 52 includes a first supply flow passage 52*a* which is substantially J-shaped in cross section and communicates with the inlet port 50 and the first pressure boosting chamber 32*a*, and a second supply flow passage 52*b* which is substantially J-shaped in cross section and communicates with the inlet port 50 and the second pressure boosting chamber 32*b*.

A first inlet check valve 52*c*, which permits the supply of the fluid from the inlet port 50 to the first pressure boosting chamber 32*a*, while preventing back-flowing of the fluid from the first pressure boosting chamber 32*a*, is provided in the first supply flow passage 52*a* on the side of the first pressure boosting chamber 32*a*. Further, a second inlet check valve 52*d*, which permits the supply of the fluid from the inlet port 50 to the second pressure boosting chamber 32*b*, while preventing back-flowing of the fluid from the second pressure boosting chamber 32*b*, is provided in the second supply flow passage 52*b* on the side of the second pressure boosting chamber 32*b*.

An output port 56, which outputs to the exterior the fluid that has been boosted in pressure in accordance with a later-described pressure boosting operation by the pressure booster 10, is formed on the front surface of the pressure boosting cylinder 12. A fluid output mechanism 58, which communicates with the output port 56, and outputs to the exterior via the output port 56 the fluid that has been boosted in pressure in the first pressure boosting chamber 32*a* or the second pressure boosting chamber 32*b*, is provided in the pressure boosting cylinder 12.

The fluid output mechanism 58 is disposed on a lower side portion of the pressure boosting chamber 32 in the pressure boosting cylinder 12. The fluid output mechanism 58 includes a first output flow passage 58*a* which is substantially J-shaped in cross section and communicates with the output port 56 and the first pressure boosting chamber 32*a*, and a second output flow passage 58*b* which is substantially J-shaped in cross section and communicates with the output port 56 and the second pressure boosting chamber 32*b*.

A first outlet check valve 58*c*, which permits output of the fluid after having been boosted in pressure from the first pressure boosting chamber 32*a* to the output port 56, while preventing back-flowing of the fluid into the first pressure boosting chamber 32*a*, is provided on the side of the first pressure boosting chamber 32*a* in the first output flow passage 58*a*. Further, a second outlet check valve 58*d*, which permits output of the fluid after having been boosted in pressure from the second pressure boosting chamber 32*b* to the output port 56, while preventing back-flowing of the fluid into the second pressure boosting chamber 32*b*, is provided on the side of the second pressure boosting chamber 32*b* in the second output flow passage 58*b*.

Figure 5:
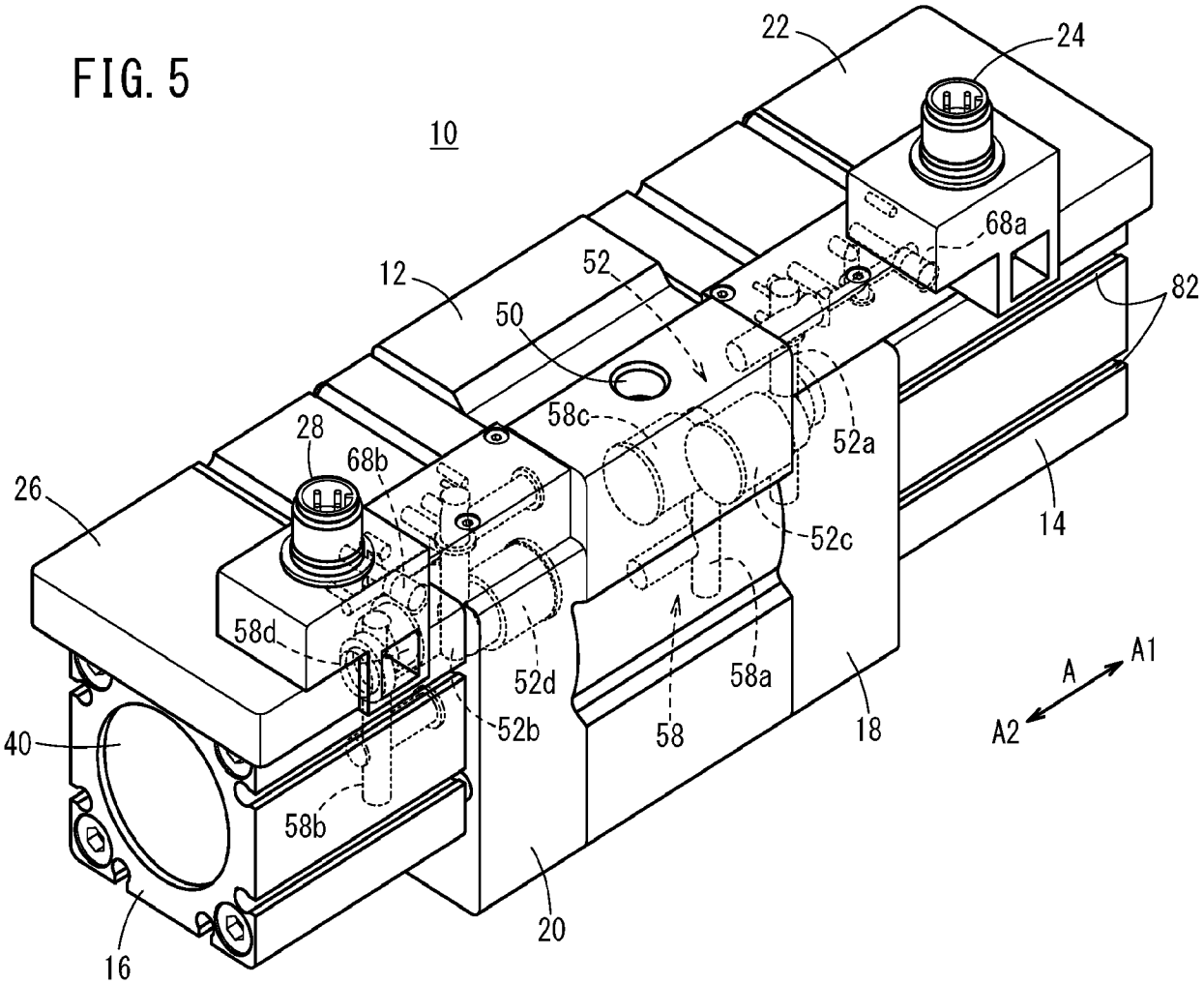
FIG. 5 is a perspective view in which there is illustrated a partial configuration of the interior of the pressure booster shown in FIG. 1.
Figure 6:
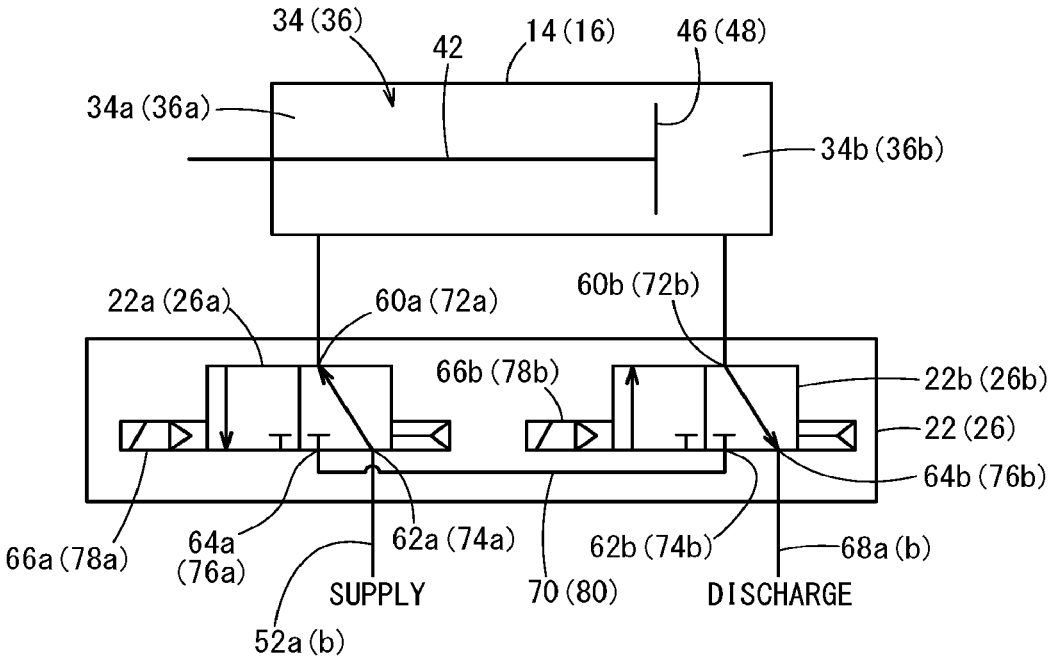
FIG. 6 is a configuration diagram of a first solenoid valve unit and a second solenoid valve unit.
Figure 7:
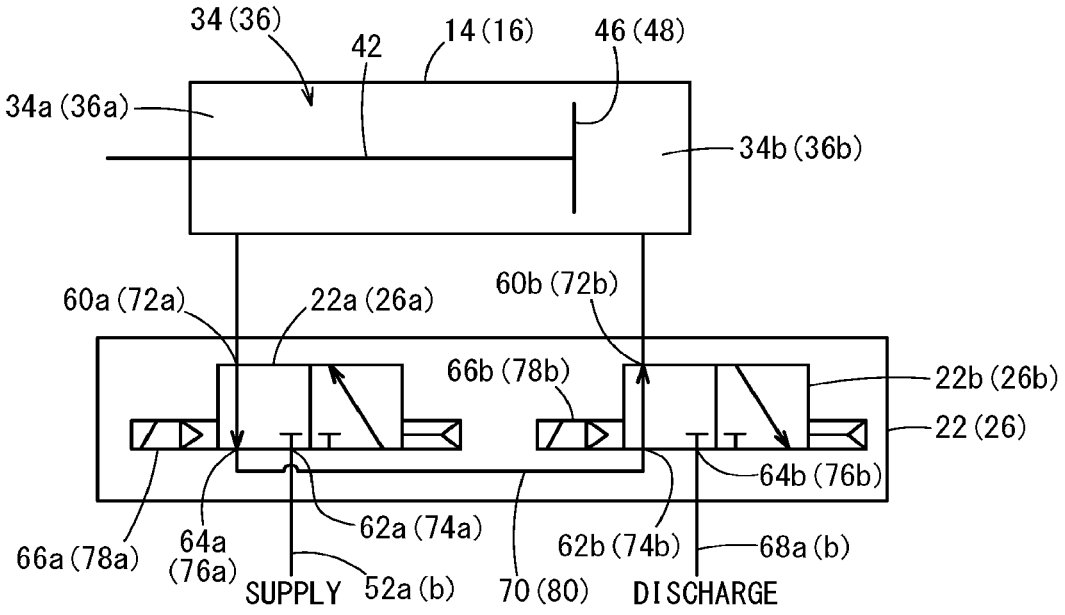
FIG. 7 is a configuration diagram of the first solenoid valve unit and the second solenoid valve unit.

As shown in FIGS. 5 to 7, the first solenoid valve unit 22 includes a first solenoid valve 22*a* serving as a supply solenoid valve which is connected to the first pressurizing chamber 34*a*, and a second solenoid valve 22*b* serving as a discharge solenoid valve which is connected to the second pressurizing chamber 34*b*. The first solenoid valve 22*a* is a single-acting two-position three-port solenoid valve, and includes a connection port 60*a* connected to the first pressurizing chamber 34*a*, a supply port 62*a* connected to the first supply flow passage 52*a*, a discharge port 64*a*, and a solenoid 66*a*. On the other hand, the second solenoid valve 22*b* is a single-acting two-position three-port solenoid valve, and includes a connection port 60*b* connected to the second pressurizing chamber 34*b*, a supply port 62*b* connected to a discharge port 64*a* of the first solenoid valve 22*a*, a discharge port 64*b* communicating with a discharge port 68*a* formed in a rear surface of the pressure booster 10, and a solenoid 66*b*. In this case, the discharge port 64*a* of the first solenoid valve 22*a* and the supply port 62*b* of the second solenoid valve 22*b* are connected at all times via a first discharge return flow passage 70.

Accordingly, by including the first solenoid valve 22*a* and the second solenoid valve 22*b*, the first solenoid valve unit 22 functions as a four-position dual three-port solenoid valve unit.

More specifically, when demagnetized (second position), i.e., when control signals are not supplied from the PLC 30 to the respective solenoids 66*a* and 66*b* via the first connector 24, as shown in FIG. 6, the supply port 62*a* and the connection port 60*a* are connected, together with the connection port 60*b* and the discharge port 64*b* being connected. Consequently, the fluid is supplied from the first supply flow passage 52*a* to the first pressurizing chamber 34*a*, whereas the fluid in the second pressurizing chamber 34*b* is discharged to the exterior through the discharge port 68*a*. As a result, by the pressure of the fluid supplied to the first pressurizing chamber 34*a*, the first drive piston 46 is displaced toward the second pressurizing chamber 34*b*.

On the other hand, when excited and magnetized (first position), i.e., in the case that control signals are supplied from the PLC 30 to the respective solenoids 66*a* and 66*b* via the first connector 24, as shown in FIG. 7, the discharge port 64*a* and the connection port 60*a* are connected, together with the supply port 62*b* and the connection port 60*b* being connected. Consequently, the first pressurizing chamber 34*a* and the second pressurizing chamber 34*b* communicate with each other through the first discharge return flow passage 70, etc. In this case, due to the presence of the piston rod 42 in the first pressurizing chamber 34*a*, the pressure receiving area of the first pressurizing chamber 34*a* is smaller than the pressure receiving area of the second pressurizing chamber 34*b*. Owing thereto, due to the pressure difference between the first pressurizing chamber 34*a* and the second pressurizing chamber 34*b* caused by the difference in the pressure receiving areas thereof, the fluid discharged from the first pressurizing chamber 34*a* flows into the second pressurizing chamber 34*b* via the first discharge return flow passage 70, etc. As a result, by the pressure of the fluid supplied to the second pressurizing chamber 34*b*, the first drive piston 46 is displaced toward the first pressurizing chamber 34*a*.

As shown in FIGS. 5 to 7, the second solenoid valve unit 26 is configured in the same manner as the aforementioned first solenoid valve unit 22, and includes a third solenoid valve 26*a* serving as a supply solenoid valve which is connected to the third pressurizing chamber 36*a*, and a fourth solenoid valve 26*b* serving as a discharge solenoid valve which is connected to the fourth pressurizing chamber 36*b*. The third solenoid valve 26*a* is a single-acting two-position three-port solenoid valve, and includes a connection port 72*a* connected to the third pressurizing chamber 36*a*, a supply port 74*a* connected to the second supply flow passage 52*b*, a discharge port 76*a*, and a solenoid 78*a*. On the other hand, the fourth solenoid valve 26*b* is a single-acting two-position three-port solenoid valve, and includes a connection port 72*b* connected to the fourth pressurizing chamber 36*b*, a supply port 74*b* connected to a discharge port 76*a* of the third solenoid valve 26*a*, a discharge port 76*b* communicating with a discharge port 68*b* formed in a rear surface of the pressure booster 10, and a solenoid 78*b*. In this case, the discharge port 76*a* of the third solenoid valve 26*a* and the supply port 74*b* of the fourth solenoid valve 26*b* are connected at all times via a second discharge return flow passage 80.

Accordingly, by including the third solenoid valve 26*a* and the fourth solenoid valve 26*b*, the second solenoid valve unit 26 also functions as a four-position dual three-port solenoid valve unit.

More specifically, when demagnetized (second position), i.e., when control signals are not supplied from the PLC 30 to the respective solenoids 78*a* and 78*b* via the second connector 28, as shown in FIG. 6, the supply port 74*a* and the connection port 72*a* are connected, together with the connection port 72*b* and the discharge port 76*b* being connected. Consequently, the fluid is supplied from the second supply flow passage 52*b* to the third pressurizing chamber 36*a*, whereas the fluid in the fourth pressurizing chamber 36*b* is discharged to the exterior through the discharge port 68*b*. As a result, by the pressure of the fluid supplied to the third pressurizing chamber 36*a*, the second drive piston 48 is displaced toward the fourth pressurizing chamber 36*b*.

On the other hand, when excited and magnetized (first position), i.e., in the case that control signals are supplied from the PLC 30 to the respective solenoids 78*a* and 78*b* via the second connector 28, as shown in FIG. 7, the discharge port 76*a* and the connection port 72*a* are connected, together with the supply port 74*b* and the connection port 72*b* being connected. Consequently, the third pressurizing chamber 36*a* and the fourth pressurizing chamber 36*b* communicate with each other through the second discharge return flow passage 80, etc. In this case, due to the presence of the piston rod 42 in the third pressurizing chamber 36*a*, the pressure receiving area of the third pressurizing chamber 36*a* is smaller than the pressure receiving area of the fourth pressurizing chamber 36*b*. Owing thereto, due to the pressure difference between the third pressurizing chamber 36*a* and the fourth pressurizing chamber 36*b* caused by the difference in the pressure receiving areas thereof, the fluid discharged from the third pressurizing chamber 36*a* flows into the fourth pressurizing chamber 36*b* via the second discharge return flow passage 80, etc. As a result, by the pressure of the fluid supplied to the fourth pressurizing chamber 36*b*, the second drive piston 48 is displaced toward the third pressurizing chamber 36*a*.

Two grooves 82 that extend in the A directions are formed above and below on each of side surfaces (a front surface on the side of the output port 56, and a rear surface on the side of the first connector 24 and the second connector 28) of each of the first drive cylinder 14 and the second drive cylinder 16. A first position detecting sensor 84*a* and a second position detecting sensor 84*b* are embedded respectively in the two grooves 82 formed on the front surface of the first drive cylinder 14. Further, an annular permanent magnet 86 is embedded in an outer circumferential surface of the first drive piston 46.

The first position detecting sensor 84*a* is a magnetic sensor, which detects the magnetism of the permanent magnet 86 when the first drive piston 46 is displaced to a location in the vicinity of the first cover member 18 inside the first drive chamber 34, and outputs a detection signal thereof to the PLC 30. The second position detecting sensor 84*b* is a magnetic sensor, which detects the magnetism of the permanent magnet 86 when the first drive piston 46 is displaced to a location in the vicinity of the third cover member 38 inside the first drive chamber 34, and outputs a detection signal thereof to the PLC 30. More specifically, the first position detecting sensor 84*a* and the second position detecting sensor 84*b* detect the position of the first drive piston 46 by detecting magnetism produced by the permanent magnet 86. On the basis of the detection signals from the first position detecting sensor 84*a* and the second position detecting sensor 84*b*, the PLC 30 outputs to the first connector 24 or the second connector 28 control signals in order to excite the respective solenoids 66*a*, 66*b*, 78*a*, and 78*b*.

[Operations of the Present Embodiment]

Operations of the pressure booster 10, which is configured in the manner described above, will be described with reference to FIGS. 8 and 9. In providing such operational descriptions, reference will also be made to FIGS. 1 to 7 as necessary.

In the pressure booster 10, as shown in FIGS. 2 to 5, the piston rod 42, the fluid supplying mechanism 52, and the fluid output mechanism 58, etc., are disposed at different positions in the front-rear direction of the pressure booster 10. However, in order to facilitate the description, in FIGS. 8 and 9, it should be noted that these components are illustrated in the same cross section.

In this instance, a description will be given of a case in which, by causing the first drive piston 46, the pressure boosting piston 44, and the second drive piston 48 to be displaced alternately in the A1 direction and the A2 direction, the fluid (for example, air) which is supplied to the first pressure boosting chamber 32*a* and the second pressure boosting chamber 32*b* is alternately boosted in pressure and output to the exterior.

At first, with reference to FIG. 8, a case will be described in which the fluid supplied to the first pressure boosting chamber 32*a* is boosted in pressure by causing the first drive piston 46, the pressure boosting piston 44, and the second drive piston 48 to be displaced in the A1 direction.

In this case, for example, the first drive piston 46 is positioned inside the first drive chamber 34 and is separated by a slight gap from the first cover member 18, the pressure boosting piston 44 is positioned inside the pressure boosting chamber 32 and is separated by a slight gap from the second cover member 20, and the second drive piston 48 is positioned inside the second drive chamber 36 and is separated by a slight gap from the fourth cover member 40.

The fluid, which is supplied from an external fluid supply source, is supplied from the inlet port 50 to the fluid supplying mechanism 52. The fluid supplying mechanism 52 supplies the fluid to the second pressure boosting chamber 32*b* via the second supply flow passage 52*b*. It should be noted that, in the first pressure boosting chamber 32*a*, fluid is already filled therein by a previous operation.

In this instance, the first position detecting sensor 84*a* detects the magnetism produced by the permanent magnet 86 that is mounted on the first drive piston 46, and outputs a detection signal thereof to the PLC 30. On the basis of the detection signal from the first position detecting sensor 84*a*, the PLC 30 outputs a control signal to the second connector 28. Consequently, the control signal is input to the second solenoid valve unit 26 via the second connector 28.

In the second solenoid valve unit 26, by supply of the control signals thereto, the solenoid 78*a* of the third solenoid valve 26*a* and the solenoid 78*b* of the fourth solenoid valve 26*b* are excited. Consequently, since the third solenoid valve 26*a* and the fourth solenoid valve 26*b* are changed to the first position shown in FIG. 7, the third pressurizing chamber 36*a* is placed in communication with the fourth pressurizing chamber 36*b* via the connection port 72*a*, the discharge port 76*a*, the second discharge return flow passage 80, the supply port 74*b*, and the connection port 72*b*. As noted previously, due to the presence of the piston rod 42, the pressure receiving area of the third pressurizing chamber 36*a* is smaller than the pressure receiving area of the fourth pressurizing chamber 36*b*. Therefore, due to the pressure difference between the third pressurizing chamber 36*a* and the fourth pressurizing chamber 36*b*, the fluid inside the third pressurizing chamber 36*a* is discharged from the third pressurizing chamber 36*a*, and is smoothly supplied to the fourth pressurizing chamber 36*b* via the second discharge return flow passage 80, etc. Due to the fluid supplied to the fourth pressurizing chamber 36*b*, the pressing force directed toward the third pressurizing chamber 36*a* (in the A1 direction) acts on the second drive piston 48.

On the other hand, in the first solenoid valve unit 22, since the control signal is not supplied thereto, the solenoid 66*a* of the first solenoid valve 22*a* and the solenoid 66*b* of the second solenoid valve 22*b* are placed in a demagnetized state. Consequently, since the first solenoid valve 22*a* and the second solenoid valve 22*b* are maintained in the second position shown in FIG. 6, the first pressurizing chamber 34*a* is connected to the first supply flow passage 52*a* via the connection port 60*a* and the supply port 62*a*, and receives the supply of fluid from the fluid supplying mechanism 52. On the other hand, the second pressurizing chamber 34*b* is connected to the discharge port 68*a* via the connection port 60*b* and the discharge port 64*b*, and the fluid inside the second pressurizing chamber 34*b* is discharged to the exterior. As a result, due to the fluid supplied to the first pressurizing chamber 34*a*, the pressing force directed toward the second pressurizing chamber 34*b* (in the A1 direction) acts on the first drive piston 46.

Figure 8:
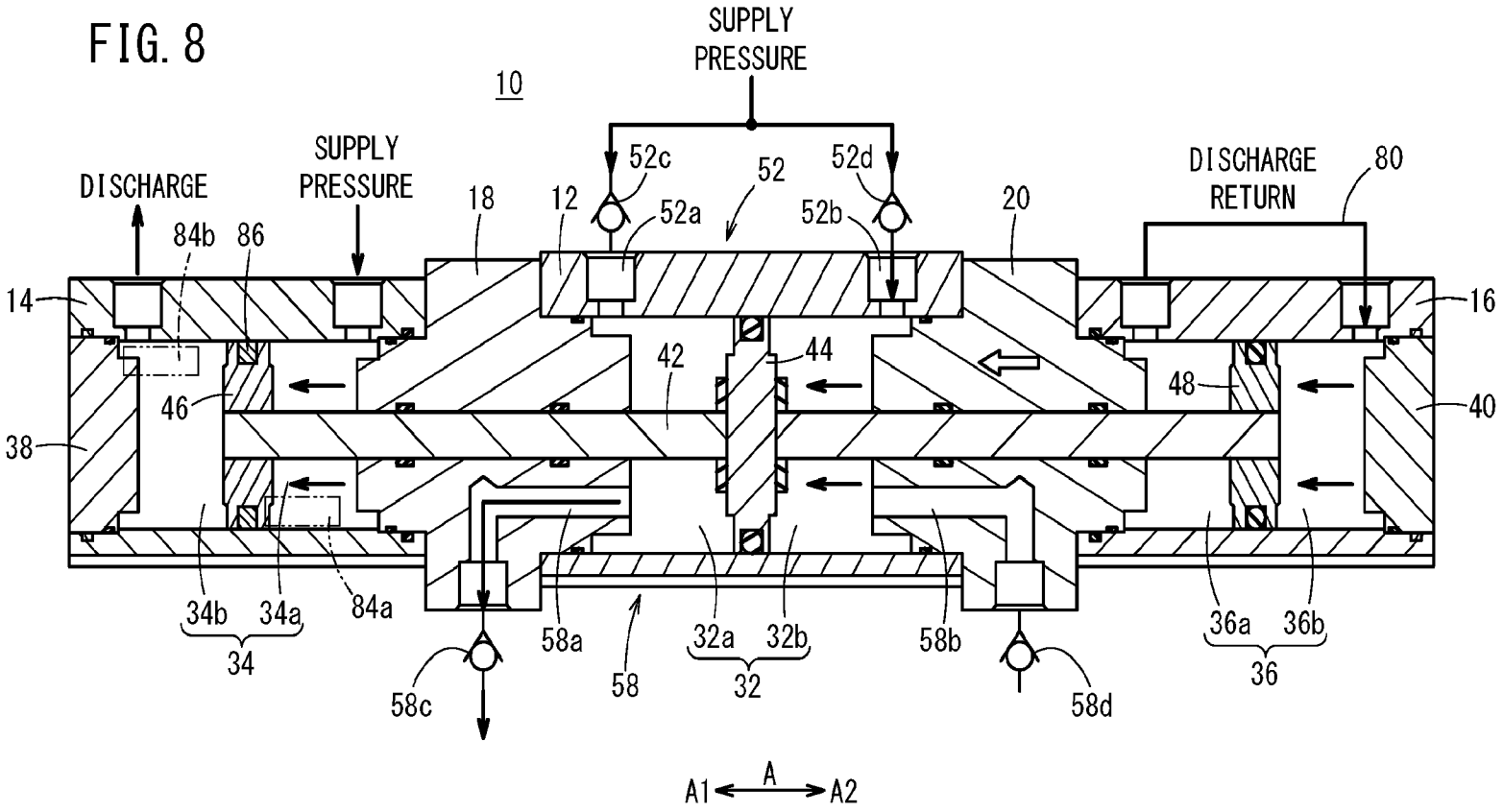
FIG. 8 is a schematic cross-sectional view showing principles of operation of the pressure booster of FIG. 1.

In this manner, in the example of FIG. 8, the fluid is supplied to the second pressure boosting chamber 32*b*, the fluid is supplied to the first pressurizing chamber 34*a*, the fluid inside the second pressurizing chamber 34*b* is discharged, and the fluid inside the third pressurizing chamber 36*a* is supplied to the fourth pressurizing chamber 36*b* via the second discharge return flow passage 80, etc. Consequently, the first drive piston 46, the pressure boosting piston 44, and the second drive piston 48 respectively receive pressing forces in the A1 direction by the fluid supplied to the first pressurizing chamber 34*a*, the second pressure boosting chamber 32*b*, and the fourth pressurizing chamber 36*b*. As a result, the first drive piston 46, the pressure boosting piston 44, the second drive piston 48, and the piston rod 42 are integrally displaced in the A1 direction as shown in FIG. 8.

Consequently, the fluid inside the first pressure boosting chamber 32*a* is compressed due to the displacement of the pressure boosting piston 44 in the A1 direction, and the pressure value thereof is increased (boosted in pressure). In the first pressure boosting chamber 32*a*, it is possible to increase the pressure of the supplied fluid to a pressure value up to three times that of the original pressure at a maximum. The fluid after having been boosted in pressure is output to the exterior through the first output flow passage 58*a* and the output port 56 of the fluid output mechanism 58.

In the case that the permanent magnet 86 is moved away from a detectable range of the first position detecting sensor 84*a* due to the movement of the first drive piston 46, the pressure boosting piston 44, the second drive piston 48, and the piston rod 42 in the A1 direction, the first position detecting sensor 84*a* stops outputting the detection signal with respect to the PLC 30. Thereafter, the first drive piston 46 arrives at a position in the vicinity of the third cover member 38 (a position separated by a slight gap from the third cover member 38), and movement of the first drive piston 46, the pressure boosting piston 44, the second drive piston 48, and the piston rod 42 in the A1 direction is stopped.

Next, with reference to FIG. 9, a case will be described in which the fluid supplied to the second pressure boosting chamber 32*b* is boosted in pressure by causing the first drive piston 46, the pressure boosting piston 44, and the second drive piston 48 to be displaced in the A2 direction.

Initially, the fluid supplying mechanism 52 supplies the fluid to the first pressure boosting chamber 32*a* via the first supply flow passage 52*a*. Moreover, by the previous operation shown in FIG. 8, the second pressure boosting chamber 32*b* is already filled with fluid. Further, the second position detecting sensor 84*b* detects the magnetism produced by the permanent magnet 86, and outputs a detection signal thereof to the PLC 30. On the basis of the detection signal from the second position detecting sensor 84*b*, the PLC 30 stops outputting the control signal to the second connector 28, while on the other hand, starts outputting a control signal to the first connector 24. Consequently, the control signal is input to the first solenoid valve unit 22 via the first connector 24.

In the first solenoid valve unit 22, by supply of the control signals thereto, the solenoid 66*a* of the first solenoid valve 22*a* and the solenoid 66*b* of the second solenoid valve 22*b* are excited. Consequently, since the first solenoid valve 22*a* and the second solenoid valve 22*b* are changed to the first position shown in FIG. 7, the first pressurizing chamber 34*a* is placed in communication with the second pressurizing chamber 34*b* via the connection port 60*a*, the discharge port 64*a*, the first discharge return flow passage 70, the supply port 62*b*, and the connection port 60*b*. In this case as well, due to the presence of the piston rod 42, the pressure receiving area of the first pressurizing chamber 34*a* is smaller than the pressure receiving area of the second pressurizing chamber 34*b*. Therefore, due to the pressure difference between the first pressurizing chamber 34*a* and the second pressurizing chamber 34*b*, the fluid inside the first pressurizing chamber 34*a* is discharged from the first pressurizing chamber 34*a*, and is smoothly supplied to the second pressurizing chamber 34*b* via the first discharge return flow passage 70, etc. Due to the fluid supplied to the second pressurizing chamber 34*b*, the pressing force directed toward the first pressurizing chamber 34*a* (in the A2 direction) acts on the first drive piston 46.

On the other hand, in the second solenoid valve unit 26, since supply of the control signal thereto from the PLC 30 is stopped, the solenoid 78*a* of the third solenoid valve 26*a* and the solenoid 78*b* of the fourth solenoid valve 26*b* are placed in a demagnetized state. Consequently, since the third solenoid valve 26*a* and the fourth solenoid valve 26*b* are changed to the second position shown in FIG. 6, the third pressurizing chamber 36*a* is connected to the second supply flow passage 52*b* via the connection port 72*a* and the supply port 74*a*, and receives the supply of fluid from the fluid supplying mechanism 52. On the other hand, the fourth pressurizing chamber 36*b* is connected to the discharge port 68*b* via the connection port 72*b* and the discharge port 76*b*, and the fluid inside the fourth pressurizing chamber 36*b* is discharged to the exterior. As a result, due to the fluid supplied to the third pressurizing chamber 36*a*, the pressing force directed toward the fourth pressurizing chamber 36*b* (in the A2 direction) acts on the second drive piston 48.

Figure 9:
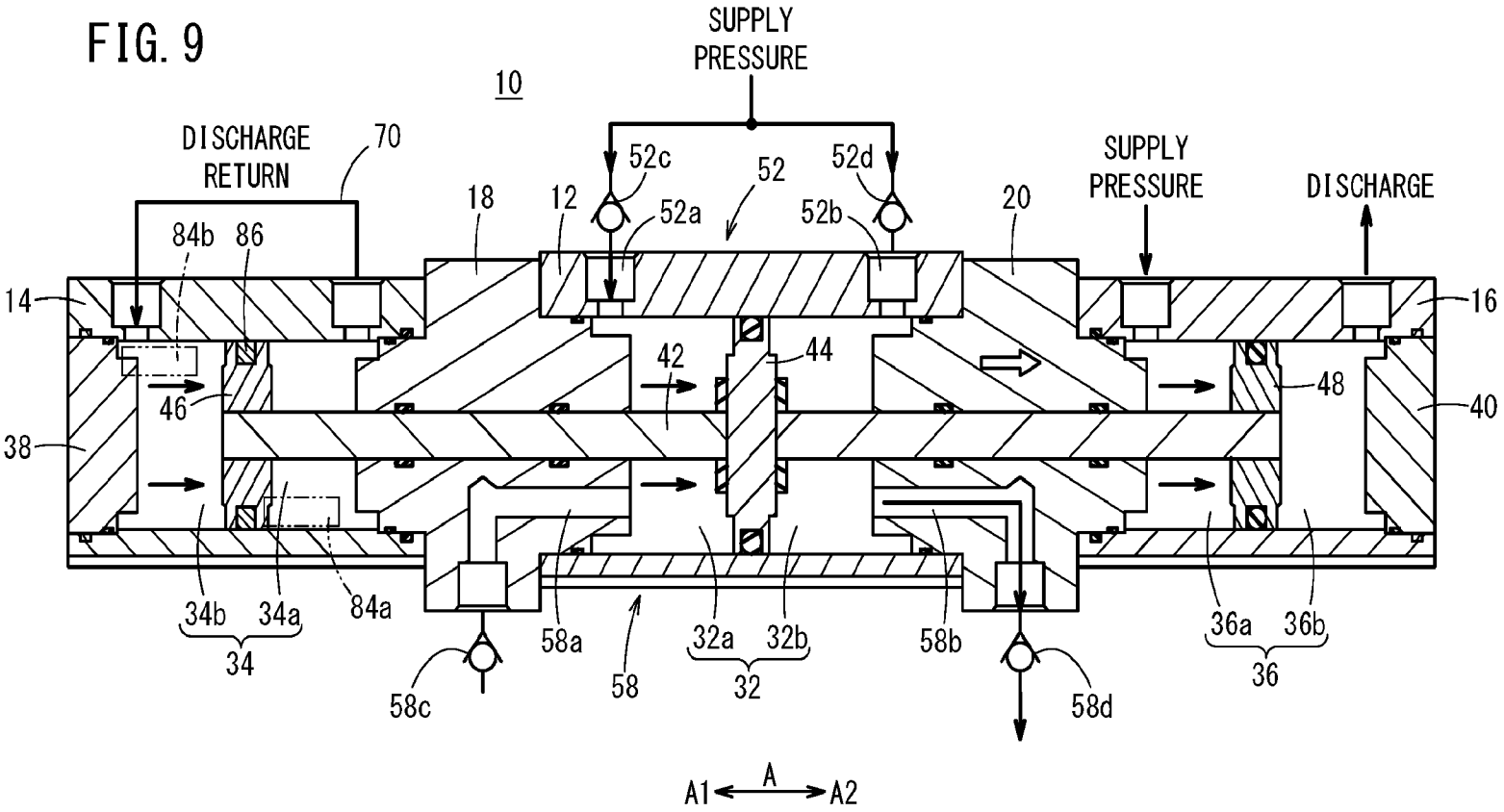
FIG. 9 is a schematic cross-sectional view showing principles of operation of the pressure booster of FIG. 1.

In this manner, in the example of FIG. 9, the fluid is supplied to the first pressure boosting chamber 32*a*, the fluid inside the first pressurizing chamber 34*a* is supplied to the second pressurizing chamber 34*b* via the first discharge return flow passage 70, etc., the fluid is supplied to the third pressurizing chamber 36*a*, and the fluid inside the fourth pressurizing chamber 36*b* is discharged. Consequently, the first drive piston 46, the pressure boosting piston 44, and the second drive piston 48 respectively receive pressing forces in the A2 direction by the fluid supplied to the second pressurizing chamber 34*b*, the first pressure boosting chamber 32*a*, and the third pressurizing chamber 36*a*. As a result, the first drive piston 46, the pressure boosting piston 44, the second drive piston 48, and the piston rod 42 are integrally displaced in the A2 direction as shown in FIG. 9.

Consequently, the fluid inside the second pressure boosting chamber 32*b* is compressed due to the displacement of the pressure boosting piston 44 in the A2 direction, and the pressure value thereof is increased (boosted in pressure). In the second pressure boosting chamber 32*b*, it is possible to increase the pressure of the supplied fluid to a pressure value up to three times that of the original pressure at a maximum.

The fluid after having been boosted in pressure is output to the exterior through the second output flow passage 58*b* of the fluid output mechanism 58.

In addition, with the pressure booster 10 according to the present embodiment, the pressure boosting operations shown in FIGS. 8 and 9 are carried out alternately by causing the first drive piston 46, the pressure boosting piston 44, the second drive piston 48, and the piston rod 42 to undergo reciprocal movement in the A1 direction and the A2 direction. Consequently, in the pressure booster 10, the pressure value of the fluid supplied from the external fluid supply source can be boosted in pressure to a pressure value up to three times that of the original pressure at a maximum, and the fluid after having been boosted in pressure can be output to the exterior through the output port 56, alternately from the first pressure boosting chamber 32*a* and the second pressure boosting chamber 32*b*.

Figure 10:
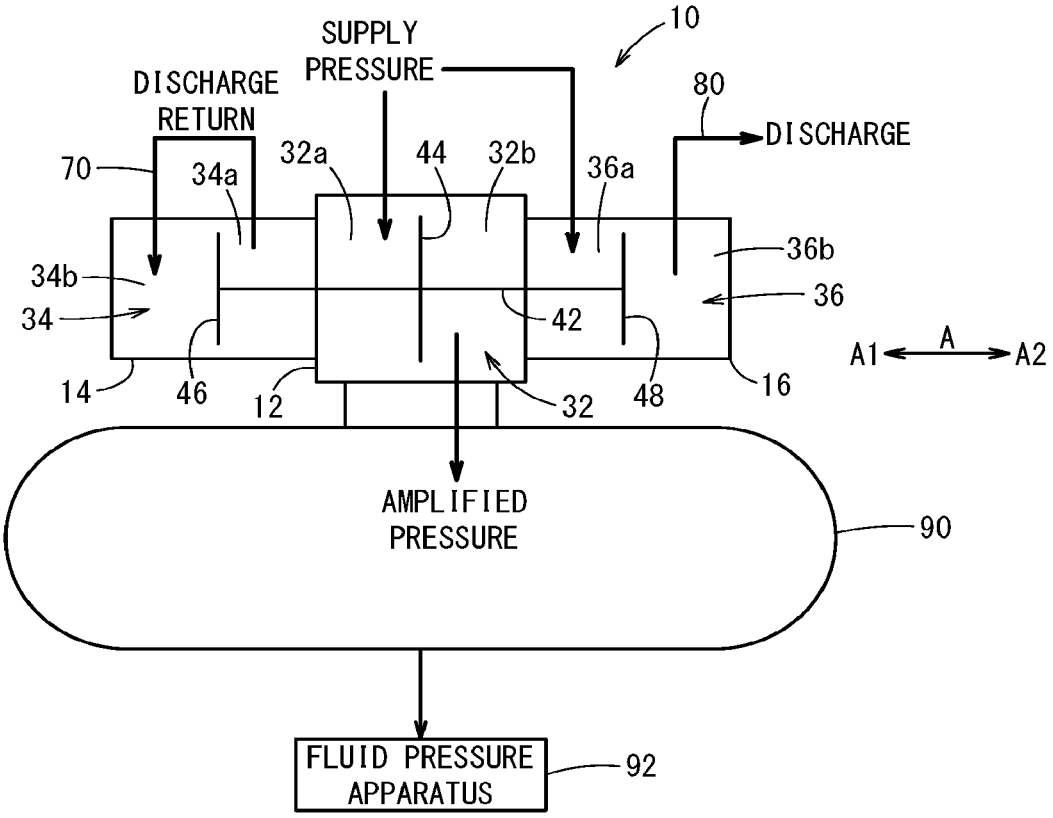
FIG. 10 is an explanatory diagram schematically illustrating the pressure booster of FIG. 1.
Figure 11:
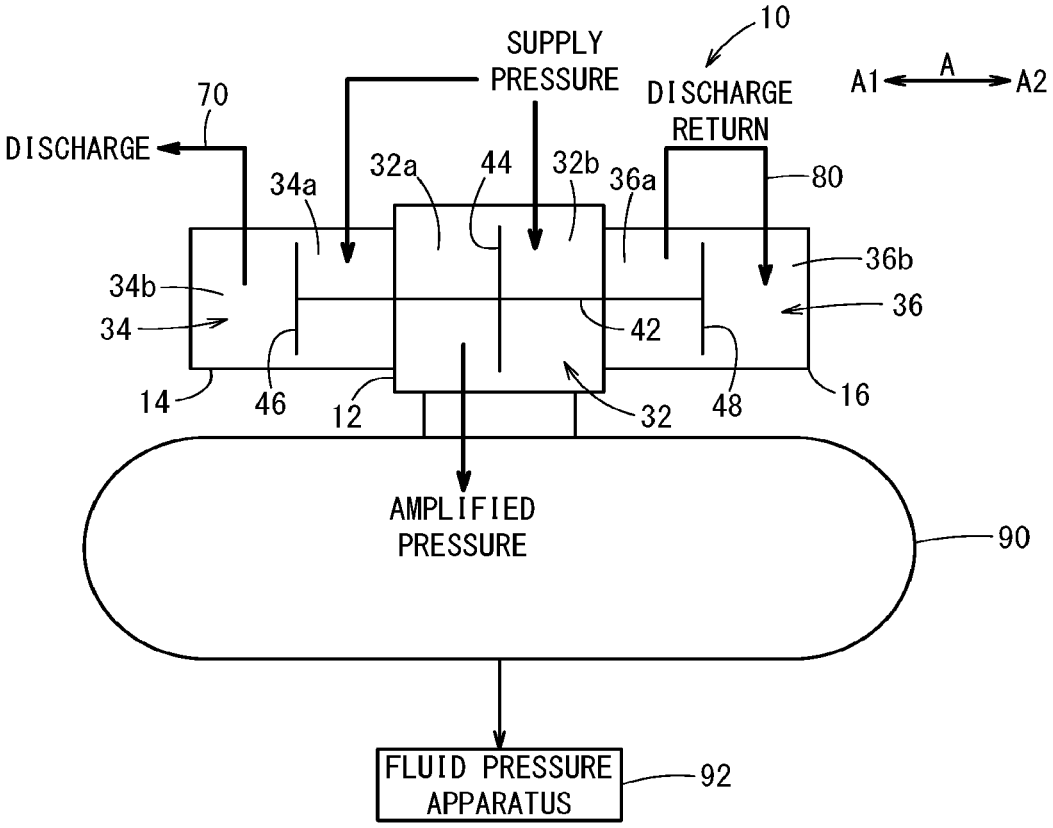
FIG. 11 is an explanatory diagram schematically illustrating the pressure booster of FIG. 1.

FIGS. 10 and 11 are explanatory diagrams schematically illustrating a case in which the fluid, which is output from the pressure booster 10 according to the present embodiment and after being boosted in pressure, is stored in an external tank 90, and the fluid after having been boosted in pressure is supplied from the tank 90 to an arbitrary fluid pressure apparatus 92.

Figure 12:
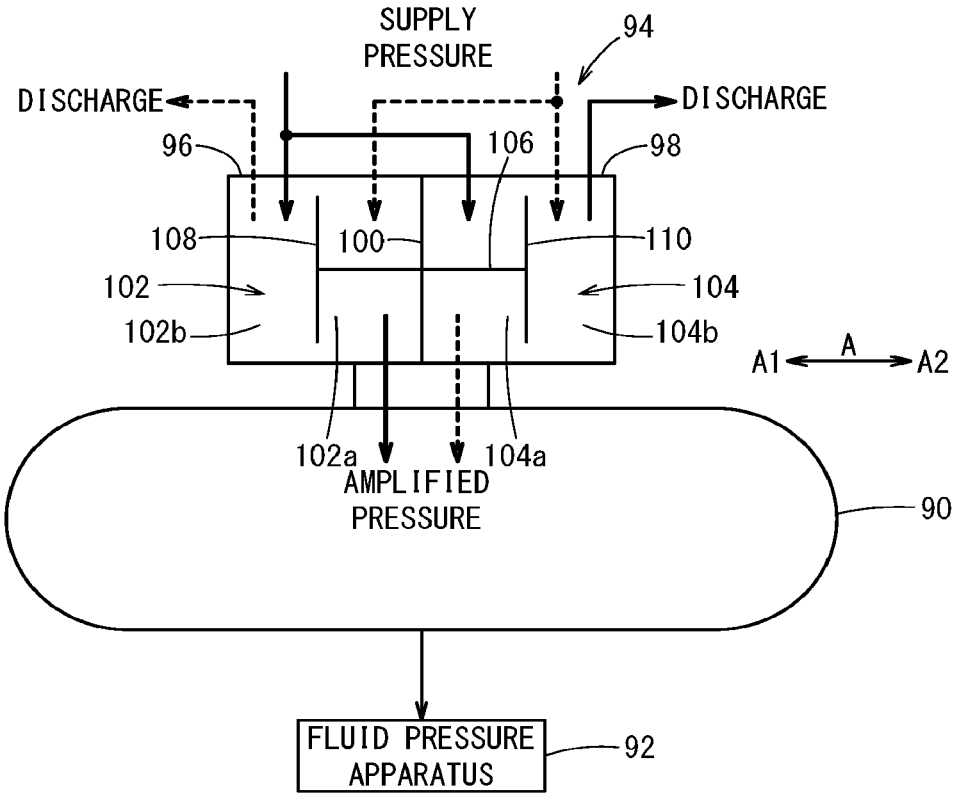
FIG. 12 is an explanatory diagram schematically illustrating a pressure booster according to a comparative example.

Further, FIG. 12 is an explanatory diagram schematically illustrating a pressure booster 94 according to a comparative example. The pressure booster 94 according to the comparative example includes a two-stage cylinder structure in which right and left cylinders 96 and 98 thereof are connected, and a cover member 100 is interposed between the cylinders 96 and 98. A cylinder chamber 102 is formed inside the left cylinder 96, and a cylinder chamber 104 is formed inside the right cylinder 98. In this case, a piston rod 106 penetrates through the cover member 100 and enters into the left and right cylinder chambers 102 and 104. The left cylinder chamber 102 is partitioned by a piston 108 connected to one end of the piston rod 106 into an inner side pressure boosting chamber 102*a* and an outer side pressurizing chamber 102*b*. On the other hand, the right cylinder chamber 104 is partitioned by a piston 110 connected to another end of the piston rod 106 into an inner side pressure boosting chamber 104*a* and an outer side pressurizing chamber 104*b*.

With the pressure booster 94 according to the comparative example, as indicated by the solid arrows, the fluid is supplied from the external fluid supply source to the pressurizing chamber 102*b* and the pressure boosting chamber 104*a*, together with the fluid in the pressurizing chamber 104*b* being discharged, whereby the pistons 108 and 110 and the piston rod 106 are integrally displaced in the A2 direction and boost the pressure of the fluid inside the pressure boosting chamber 102*a*. Further, with the pressure booster 94, as indicated by the dashed arrows, the fluid is supplied from the external fluid supply source to the pressure boosting chamber 102*a* and the pressurizing chamber 104*b*, and the fluid in the pressurizing chamber 102*b* is discharged, whereby the pistons 108 and 110 and the piston rod 106 are integrally displaced in the A1 direction and boost the pressure of the fluid inside the pressure boosting chamber 104*a*. Accordingly, by the reciprocating motion in the A1 direction and the A2 direction of the pistons 108 and 110 and the piston rod 106, the pressure booster 94 alternately boosts the pressure of the fluid inside the pressure boosting chambers 102*a* and 104*a*, and the fluid after having been boosted in pressure can be output to the tank 90.

However, in the pressure booster 94 according to the comparative example, the pressure value of the supplied fluid can be increased only to a pressure value up to two times that of the original pressure at a maximum. Further, the fluid is also supplied from the fluid supply source to the respective pressurizing chambers 102*b* and 104*b*, and each time that the pistons 108 and 110 and the piston rod 106 are moved reciprocally, because the fluid from either one of the pressurizing chambers 102*b* and 104*b* is discharged, the amount of fluid consumption is increased. Furthermore, in order to avoid balancing of the pressures in the chambers on both sides of the pistons 108 and 110, it is necessary for a component such as a non-illustrated spring member to be utilized, which makes the internal structure of the pressure booster 94 complex.

In contrast thereto, in the pressure booster 10 according to the present embodiment shown in FIGS. 10 and 11, as described above, the pressure value of the supplied fluid can be increased to a pressure value up to three times that of the original pressure at a maximum. Further, using the first solenoid valve unit 22 and the second solenoid valve unit 26, the fluid discharged from one of the pressurizing chambers is supplied to the other pressurizing chamber. Consequently, wasteful discharge of the fluid can be avoided, and conservation of energy can be realized. Furthermore, because the fluid discharged from one of the pressurizing chambers is supplied to the other pressurizing chamber utilizing the pressure difference caused by the difference in the pressure receiving areas on both sides of the first drive piston 46 and the second drive piston 48, it is possible to avoid stoppage of the first drive piston 46 and the second drive piston 48 due to balancing of the pressures, and the internal structure of the pressure booster 10 can be simplified. Accordingly, in the pressure booster 10, the fluid after having been boosted in pressure can be efficiently stored in the tank 90, and the stored fluid can be suitably supplied to the fluid pressure apparatus 92.

[Advantages and Effects of the Present Embodiment]

As has been described above, the pressure booster 10 according to the present embodiment includes a three-stage cylinder structure in which the first drive chamber 34, the pressure boosting chamber 32, and the second drive chamber 36 are formed sequentially along the piston rod 42 (in the A directions). In this case, when the fluid is supplied from the fluid supplying mechanism 52 to at least one from among the first pressure boosting chamber 32*a* and the second pressure boosting chamber 32*b*, in the first drive chamber 34 and the second drive chamber 36 on the outer sides, in accordance with operation of the first solenoid valve unit 22 or the second solenoid valve unit 26, by supplying the fluid discharged from the first pressurizing chamber 34*a* or the third pressurizing chamber 36*a* on the inner sides on the side of the pressure boosting chamber 32 to the second pressurizing chamber 34*b* or the fourth pressurizing chamber 36*b* on the outer sides, the first drive piston 46, the pressure boosting piston 44, and the second drive piston 48 can be made to undergo movement along the A directions.

More specifically, in the case that the fluid flows into the second pressurizing chamber 34*b* and the first drive piston 46 is pressed toward the first pressurizing chamber 34*a*, the first drive piston 46, the pressure boosting piston 44, and the second drive piston 48 can be moved toward the second drive chamber 36 (in the A2 direction). As a result, the fluid inside the second pressure boosting chamber 32*b* can be boosted in pressure.

On the other hand, in the case that the fluid flows into the fourth pressurizing chamber 36*b* and the second drive piston 48 is pressed toward the third pressurizing chamber 36*a*, the first drive piston 46, the pressure boosting piston 44, and the second drive piston 48 can be moved toward the first drive chamber 34 (in the A1 direction). As a result, the fluid inside the first pressure boosting chamber 32*a* can be boosted in pressure.

In either of these cases, in the pressure booster 10, the fluid supplied from the exterior via the fluid supplying mechanism 52 is used in order to boost the pressure inside the centrally located first pressure boosting chamber 32*a* or second pressure boosting chamber 32*b*, and movement of the first drive piston 46, the pressure boosting piston 44, and the second drive piston 48 is performed due to movement of the discharged fluid between the pressurizing chambers in accordance with operation of the first solenoid valve unit 22 and the second solenoid valve unit 26.

Consequently, according to the present embodiment, with a simple structure, and by the first drive piston 46, the pressure boosting piston 44, and the second drive piston 48 being displaced without causing the pressure values on both sides of the first drive piston 46 and the second drive piston 48 to be balanced, the fluid supplied to the first pressure boosting chamber 32*a* or the second pressure boosting chamber 32*b* can easily be boosted in pressure.

Further, in the pressure booster 10, movement of the discharged fluid between the pressurizing chambers as performed by the first solenoid valve unit 22 and the second solenoid valve unit 26 is carried out alternately, and by the first drive piston 46, the pressure boosting piston 44, and the second drive piston 48 being moved reciprocally, the fluid supplied to the first pressure boosting chamber 32*a* and the second pressure boosting chamber 32*b* can be alternately boosted in pressure, and the fluid after having been boosted in pressure can be output to the exterior. Consequently, the pressure of the fluid supplied from the exterior to the first pressure boosting chamber 32*a* or the second pressure boosting chamber 32*b* via the fluid supplying mechanism 52 can be boosted to a pressure value up to three times that of the original pressure at a maximum and output to the exterior.

However, depending on the specifications of the fluid pressure apparatus 92 to which the fluid that was boosted in pressure is supplied, a pressure value less than three times, for example, a pressure value that is two times that of the original pressure may be sufficient. If the size of the pressure booster 10 in a diametrical direction (a direction perpendicular to the A directions) is set to be small corresponding to such specifications, the flow rate of the fluid supplied to the first pressure boosting chamber 32*a* or the second pressure boosting chamber 32*b* from the exterior via the fluid supplying mechanism 52 becomes smaller, and it is possible to easily output to the exterior a fluid of a pressure value that is two times that of the original pressure. Consequently, in comparison with a conventional pressure booster, the consumption of the supplied fluid is reduced, and more specifically, in comparison with the pressure booster 94 shown in FIG. 12, consumption of the fluid can be reduced by about 50%, and energy conservation of the pressure booster 10 can be realized. Further, by specifying the pressure value to be two times that of the original pressure, since a surplus in the capacity of the pressure boosting operation of the pressure booster 10 can be realized, it is possible to prolong the service life of the pressure booster 10.

In the foregoing manner, since it is possible to reduce the size and scale of the device, the pressure booster 10 can be suitably adopted for use with automated assembly equipment for which it is necessary to limit the weight of the cylinder accompanying a reduction in the weight and size of the equipment.

Further, according to the present embodiment, in the case that the fluid is supplied from the fluid supplying mechanism 52 to the first pressure boosting chamber 32*a*, at least the first solenoid valve unit 22 supplies the fluid discharged from the first pressurizing chamber 34*a* to the second pressurizing chamber 34*b*. On the other hand, in the case that the fluid is supplied from the fluid supplying mechanism 52 to the second pressure boosting chamber 32*b*, at least the second solenoid valve unit 26 supplies the fluid discharged from the third pressurizing chamber 36*a* to the fourth pressurizing chamber 36*b*.

In accordance with this feature, when the first drive piston 46, the pressure boosting piston 44, and the second drive piston 48 undergo reciprocal movement, the fluid supplied to the first pressurizing chamber 34*a* or the third pressurizing chamber 36*a* during movement in one direction can be supplied from the first pressurizing chamber 34*a* to the second pressurizing chamber 34*b*, or alternatively, can be supplied from the third pressurizing chamber 36*a* to the fourth pressurizing chamber 36*b* during movement in the other direction. That is, according to the present embodiment, by the fluid discharged from one of the pressurizing chambers being recovered and supplied to the other pressurizing chamber, the fluid is utilized again. Consequently, in comparison with a situation, as in the conventional technique, in which fluid is discharged from the pressurizing chambers each time that the pistons move, the fluid supplied to the first pressure boosting chamber 32*a* and the second pressure boosting chamber 32*b* can be boosted in pressure while the amount of fluid consumption in the pressure booster 10 as a whole is reduced.

In addition, in the pressure booster 10 according to the present embodiment, a first fluid supplying method is adopted in which there is used a difference in the pressure receiving areas on both sides of the first drive piston 46 and the second drive piston 48.

More specifically, in the case that the fluid is supplied from the fluid supplying mechanism 52 to the first pressure boosting chamber 32*a*, the first solenoid valve unit 22 supplies the fluid discharged from the first pressurizing chamber 34*a* to the second pressurizing chamber 34*b*, based on a difference, on the first drive piston 46, between a pressure receiving area on the side of the first pressurizing chamber 34*a* and a pressure receiving area on the side of the second pressurizing chamber 34*b*. Further, the second solenoid valve unit 26 supplies the fluid to the third pressurizing chamber 36*a* together with discharging the fluid from the fourth pressurizing chamber 36*b*.

On the other hand, in the case that the fluid is supplied from the fluid supplying mechanism 52 to the second pressure boosting chamber 32*b*, the first solenoid valve unit 22 supplies the fluid to the first pressurizing chamber 34*a* together with discharging the fluid from the second pressurizing chamber 34*b*. Further, the second solenoid valve unit 26 supplies the fluid discharged from the third pressurizing chamber 36*a* to the fourth pressurizing chamber 36*b*, based on a difference, on the second drive piston 48, between a pressure receiving area on the side of the third pressurizing chamber 36*a* and a pressure receiving area on the side of the fourth pressurizing chamber 36*b*.

More specifically, when the first pressurizing chamber 34*a* and the second pressurizing chamber 34*b* are compared, because the piston rod 42 is present in the first pressurizing chamber 34*a*, the pressure receiving area thereof is reduced.

Accordingly, the fluid discharged from the first pressurizing chamber 34*a* moves smoothly into the second pressurizing chamber 34*b*, due to a pressure difference caused by the difference in the pressure receiving areas between the first pressurizing chamber 34*a* and the second pressurizing chamber 34*b*. Consequently, by the fluid that has flowed into the second pressurizing chamber 34*b*, the first drive piston 46 is pressed toward the first pressurizing chamber 34*a*, and therefore, the first drive piston 46, the pressure boosting piston 44, and the second drive piston 48 can be moved toward the second drive chamber 36. As a result, the fluid supplied to the second pressure boosting chamber 32*b* can be easily boosted in pressure.

On the other hand, in the same manner as the case of the first pressurizing chamber 34*a* and the second pressurizing chamber 34*b*, when the third pressurizing chamber 36*a* and the fourth pressurizing chamber 36*b* are compared, because the piston rod 42 is present in the third pressurizing chamber 36*a*, the pressure receiving area thereof is reduced. Accordingly, the fluid discharged from the third pressurizing chamber 36*a* moves smoothly into the fourth pressurizing chamber 36*b*, due to a pressure difference caused by the difference in the pressure receiving areas between the third pressurizing chamber 36*a* and the fourth pressurizing chamber 36*b*. Consequently, by the fluid that has flowed into the fourth pressurizing chamber 36*b*, the second drive piston 48 is pressed toward the third pressurizing chamber 36*a*, and therefore, the first drive piston 46, the pressure boosting piston 44, and the second drive piston 48 can be moved toward the first drive chamber 34. As a result, the fluid supplied to the first pressure boosting chamber 32*a* can be easily boosted in pressure.

Further, the first solenoid valve unit 22 is configured to include the first solenoid valve 22*a*, the second solenoid valve 22*b*, and the first discharge return flow passage 70, and at the first position of the first solenoid valve 22*a* and the second solenoid valve 22*b*, the first pressurizing chamber 34*a* and the second pressurizing chamber 34*b* communicate with each other through the first discharge return flow passage 70 etc. On the other hand, at the second position of the first solenoid valve 22*a* and the second solenoid valve 22*b*, the first pressurizing chamber 34*a* communicates with the fluid supplying mechanism 52, and the second pressurizing chamber 34*b* communicates with the exterior.

Furthermore, the second solenoid valve unit 26 is configured to include the third solenoid valve 26*a*, the fourth solenoid valve 26*b*, and the second discharge return flow passage 80, and at the first position of the third solenoid valve 26*a* and the fourth solenoid valve 26*b*, the third pressurizing chamber 36*a* and the fourth pressurizing chamber 36*b* communicate with each other through the second discharge return flow passage 80. On the other hand, at the second position of the third solenoid valve 26*a* and the fourth solenoid valve 26*b*, the third pressurizing chamber 36*a* communicates with the fluid supplying mechanism 52, and the fourth pressurizing chamber 36*b* communicates with the exterior.

In accordance with this feature, based on the supply of control signals from the external PLC 30 to the first to fourth solenoid valves 22*a*, 22*b*, 26*a*, and 26*b*, it is possible for the first solenoid valve unit 22 and the second solenoid valve unit 26 to reliably and efficiently carry out switching between the operations of supplying and discharging the fluid, and the operation (discharge return operation) of supplying the discharged fluid.

Further, in the pressure booster 10, the first position detecting sensor 84*a* and the second position detecting sensor 84*b* detect the position of the first drive piston 46, and in accordance with the control signal from the PLC 30 which is based on the detection results of the first position detecting sensor 84*a* and the second position detecting sensor 84*b*, the first solenoid valve unit 22 and the second solenoid valve unit 26 execute switching between an operation of supplying the fluid and discharging the fluid to the exterior, and an operation of supplying the fluid discharged from one of the pressurizing chambers to the other pressurizing chamber. In accordance with this feature, an increase in the pressure of the fluid supplied to the first pressure boosting chamber 32*a* and the second pressure boosting chamber 32*b* can be efficiently carried out.

Further, conventionally, operations of supplying and discharging the fluid are switched, as a result of knock pins being incorporated in the pressure booster, and the pistons being caused to abut against the knock pins. However, there is a problem in that sounds (hammering noises) which occur each time that the pistons move and abut against the knock pins produce noise, and the sounds (operating sounds) generated by the pressure booster during operation of the pistons is large.

In contrast thereto, with the pressure booster 10 according to the present embodiment, as described above, since the operation of supplying the fluid discharged from one of the pressurizing chambers to the other pressurizing chamber is performed on the basis of the detection results of the first position detecting sensor 84*a* and the second position detecting sensor 84*b*, the aforementioned knock pins are rendered unnecessary. As a result, noises generated upon movement of the first drive piston 46, the pressure boosting piston 44, and the second drive piston 48 can be suppressed, and operating sounds of the pressure booster 10 can be reduced.

In this case, the first position detecting sensor 84*a* detects the arrival of the first drive piston 46 at the side in the A2 direction of the first drive chamber 34, whereas the second position detecting sensor 84*b* detects the arrival of the first drive piston 46 at the side in the A1 direction of the first drive chamber 34. Therefore, a directional control valve for driving the first drive piston 46, the pressure boosting piston 44, and the second drive piston 48 is rendered unnecessary, and the internal structure of the pressure booster 10 is simplified. As a result, it is possible to enhance the productivity of the pressure booster 10.

Further, the first position detecting sensor 84*a* and the second position detecting sensor 84*b* are magnetic sensors that detect the position of the first drive piston 46 by detecting magnetism produced by the permanent magnet 86 attached to the first drive piston 46, and therefore, it is possible to easily and accurately detect the position of the first drive piston 46.

Further, the fluid supplying mechanism 52 is configured to include the first inlet check valve 52*c* that prevents back-flowing of the fluid from the first pressure boosting chamber 32*a*, and the second inlet check valve 52*d* that prevents back-flowing of the fluid from the second pressure boosting chamber 32*b*. On the other hand, the fluid output mechanism 58 is configured to include the first outlet check valve 58*c* that prevents back-flowing of the fluid into the first pressure boosting chamber 32*a*, and the second outlet check valve 58*d* that prevents back-flowing of the fluid into the second pressure boosting chamber 32*b*. In accordance with this feature, an increase in pressure with respect to the supplied fluid can be reliably carried out in the first pressure boosting chamber 32*a* and the second pressure boosting chamber 32*b*.

Furthermore, if a size of the first drive chamber 34 in its diametrical direction and a size of the second drive chamber 36 in its diametrical direction are made smaller than a size of the pressure boosting chamber 32 in its diametrical direction, it is possible to realize a reduction in the size of the pressure booster 10 as a whole. Further, by reducing the sizes of the first drive chamber 34 and the second drive chamber 36, the flow rate (consumption rate) of the fluid discharged from the first to fourth pressurizing chambers 34*a*, 34*b*, 36*a*, and 36*b* can be reduced. Consequently, it is possible suppress noise (noise generated upon passage through a non-illustrated silencer) that is generated when the fluid is discharged from the discharge ports 68*a* and 68*b*.

Furthermore, the first to fourth cover members 18, 20, 38, and 40 are arranged in the pressure booster 10. In this case, the first drive piston 46 is displaced inside the first drive chamber 34 without coming into contact with the first cover member 18 and the third cover member 38. Further, the second drive piston 48 is displaced inside the second drive chamber 36 without coming into contact with the second cover member 20 and the fourth cover member 40. Furthermore, the pressure boosting piston 44 is displaced inside the pressure boosting chamber 32 without coming into contact with the first cover member 18 and the second cover member 20.

In accordance with this feature, the first drive piston 46, the pressure boosting piston 44, the second drive piston 48, and the piston rod 42 are capable of being moved smoothly when the fluid is supplied to or discharged from the first to fourth pressurizing chambers 34*a*, 34*b*, 36*a*, and 36*b*, the first pressure boosting chamber 32*a*, and the second pressure boosting chamber 32*b*.

In the above description, although a case has been described in which the first position detecting sensor 84*a* and the second position detecting sensor 84*b* detect the position of the first drive piston 46, it is a matter of course that the same effects can be obtained even in the case that the first position detecting sensor 84*a* and the second position detecting sensor 84*b* are embedded in the grooves 82 of the second drive cylinder 16, the permanent magnet 86 is attached to the second drive piston 48, and the position of the second drive piston 48 is detected by the first position detecting sensor 84*a* and the second position detecting sensor 84*b*.

[Description of Modifications]

Next, with reference to FIGS. 13 to 16, descriptions will be made concerning modifications of the pressure booster 10 according to the present embodiment (a pressure booster 10A according to a first modification, and a pressure booster 10B according to a second modification). The same constituent elements as those of the pressure booster 10 (see FIGS. 1 to 11) are denoted with the same reference characters, and detailed description of such features is omitted.

First, the pressure booster 10A according to the first modification will be described with reference to FIGS. 13 and 14. The pressure booster 10A according to the first modification differs from the pressure booster 10 in that, as a second fluid supplying method, both the first solenoid valve unit 22 and the second solenoid valve unit 26 perform the discharge return operation together, whereby the first drive piston 46, the pressure boosting piston 44, and the second drive piston 48 are made to move in the A directions. Moreover, it should be noted that in the first modification, unlike the pressure booster 10, the operation of supplying the fluid is not carried out on the basis of a difference in the pressure receiving areas.

In order to realize the second fluid supplying method, the pressure booster 10A of the first modification includes the following configuration. More specifically, in the first solenoid valve unit 22, a fifth solenoid valve 120, which is a single-acting two-position three-port three-way valve, and a first pressure switch 122 (pressure sensor) are disposed midway along the first discharge return flow passage 70 that communicates with the first pressurizing chamber 34*a* and the second pressurizing chamber 34*b*. Further, in the second solenoid valve unit 26, a sixth solenoid valve 124, which is a single-acting two-position three-port three-way valve, and a second pressure switch 126 (pressure sensor) are disposed midway along the second discharge return flow passage 80 that communicates with the third pressurizing chamber 36*a* and the fourth pressurizing chamber 36*b*.

In the first solenoid valve unit 22, the fifth solenoid valve 120 includes a connection port 128 connected to the first pressurizing chamber 34*a*, a connection port 130 connected to the second pressurizing chamber 34*b* via the first pressure switch 122, and a solenoid 132. Further, in the case that the first pressurizing chamber 34*a* and the second pressurizing chamber 34*b* are placed in communication via the fifth solenoid valve 120, when the first pressure switch 122 detects that the pressure value of the fluid flowing through the first discharge return flow passage 70 has decreased to a predetermined threshold value, a pressure signal indicative of such a detection result is output to the PLC 30 via the first connector 24. Based on input of the pressure signal, the PLC 30 controls the solenoid 132 via the first connector 24.

On the other hand, in the second solenoid valve unit 26, the sixth solenoid valve 124 includes a connection port 134 connected to the third pressurizing chamber 36*a*, a connection port 136 connected to the fourth pressurizing chamber 36*b* via the second pressure switch 126, and a solenoid 138. Further, in the case that the third pressurizing chamber 36*a* and the fourth pressurizing chamber 36*b* are placed in communication via the sixth solenoid valve 124, when the second pressure switch 126 detects that the pressure value of the fluid flowing through the second discharge return flow passage 80 has decreased to a predetermined threshold value, a pressure signal indicative of such a detection result is output to the PLC 30 via the second connector 28. Based on input of the pressure signal, the PLC 30 controls the solenoid 138 via the second connector 28.

Figure 13:
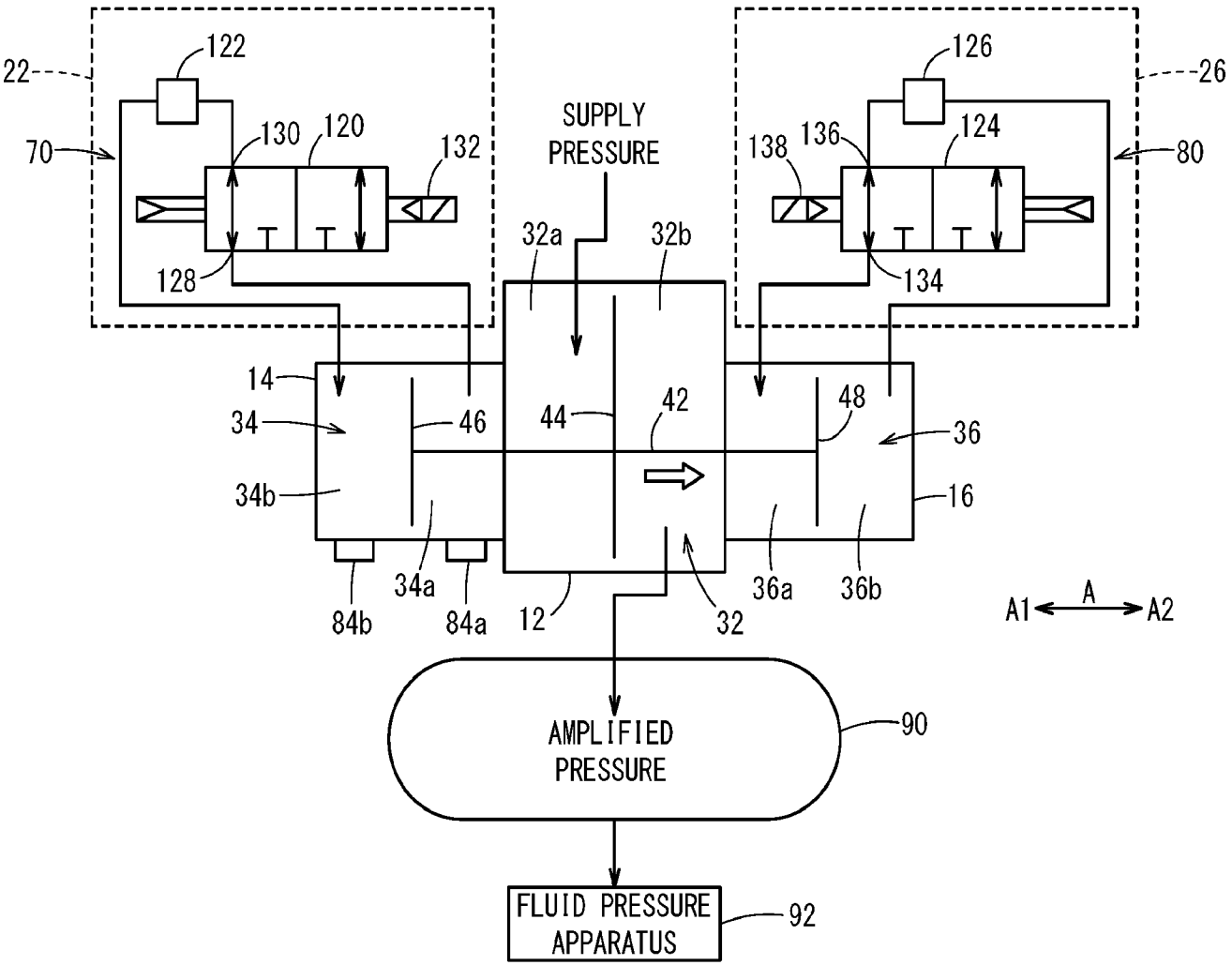
FIG. 13 is an explanatory diagram schematically illustrating a pressure booster according to a first modification.

In addition, according to the first modification, as shown in FIG. 13, in a state in which the fluid is supplied to (accumulated in) the second pressure boosting chamber 32*b*, in the case that the fluid is supplied from the fluid supplying mechanism 52 to the first pressure boosting chamber 32*a*, at first, a control signal is supplied from the PLC 30 to the second connector 28. Consequently, the solenoid 138 is excited and magnetized (first position), and since the two connection ports 134 and 136 are connected, the third pressurizing chamber 36*a* and the fourth pressurizing chamber 36*b* communicate with each other. In this case, since the control signal is not supplied from the PLC 30 to the first connector 24, the solenoid 132 is in a demagnetized state (second position), the two connection ports 128 and 130 are connected, and the first pressurizing chamber 34*a* and the second pressurizing chamber 34*b* communicate with each other.

As a result, the fluid in the first pressurizing chamber 34*a* is discharged to the first discharge return flow passage 70, and is supplied to the second pressurizing chamber 34*b* via the two connection ports 128 and 130 and the first pressure switch 122. By the pressure of the fluid supplied to the second pressurizing chamber 34*b*, the first drive piston 46 is pressed toward the first pressurizing chamber 34*a*. Further, the fluid in the fourth pressurizing chamber 36*b* is discharged to the second discharge return flow passage 80, and is supplied to the third pressurizing chamber 36*a* via the second pressure switch 126 and the two connection ports 134 and 136. By the pressure of the fluid supplied to the third pressurizing chamber 36*a*, the second drive piston 48 is pressed toward the fourth pressurizing chamber 36*b*.

Accordingly, in the example of FIG. 13, by supplying the fluid to the first pressure boosting chamber 32*a*, the second pressurizing chamber 34*b*, and the third pressurizing chamber 36*a*, the first drive piston 46, the pressure boosting piston 44, the second drive piston 48, and the piston rod 42 are displaced integrally in the A2 direction. Consequently, the fluid inside the second pressure boosting chamber 32*b* is boosted in pressure and discharged to the tank 90.

The pressures of the respective fluids flowing through the first discharge return flow passage 70 and the second discharge return flow passage 80 decrease over time. In addition, in the case that the first pressure switch 122 detects that the pressure of the fluid flowing through the first discharge return flow passage 70 has decreased to a predetermined threshold value, the first pressure switch 122 outputs a detection result as a pressure signal to the PLC 30 via the first connector 24. Further, in the case that the second pressure switch 126 detects that the pressure of the fluid flowing through the second discharge return flow passage 80 has decreased to a predetermined threshold value, the second pressure switch 126 outputs a detection result as a pressure signal to the PLC 30 via the second connector 28.

In the case that the respective pressure signals are input thereto from the first pressure switch 122 and the second pressure switch 126, the PLC 30 determines that the first drive piston 46, the pressure boosting piston 44, the second drive piston 48, and the piston rod 42 have been displaced, by the supply of fluid through the first discharge return flow passage 70 and the second discharge return flow passage 80, respectively to locations in the vicinity of the end in the A2 direction of the first drive chamber 34, the pressure boosting chamber 32, and the second drive chamber 36. Then, the PLC 30 stops supplying the control signal to the second connector 28, together with starting to supply the control signal from the PLC 30 to the first connector 24. Consequently, the solenoid 132 is placed in a magnetized state (first position), communication between the two connection ports 128 and 130 is interrupted, and the supply of fluid from the first pressurizing chamber 34*a* to the second pressurizing chamber 34*b* is stopped. On the other hand, the solenoid 138 is placed in a demagnetized state (second position), communication between the two connection ports 134 and 136 is interrupted, and the supply of fluid from the fourth pressurizing chamber 36*b* to the third pressurizing chamber 36*a* is stopped.

Figure 14:
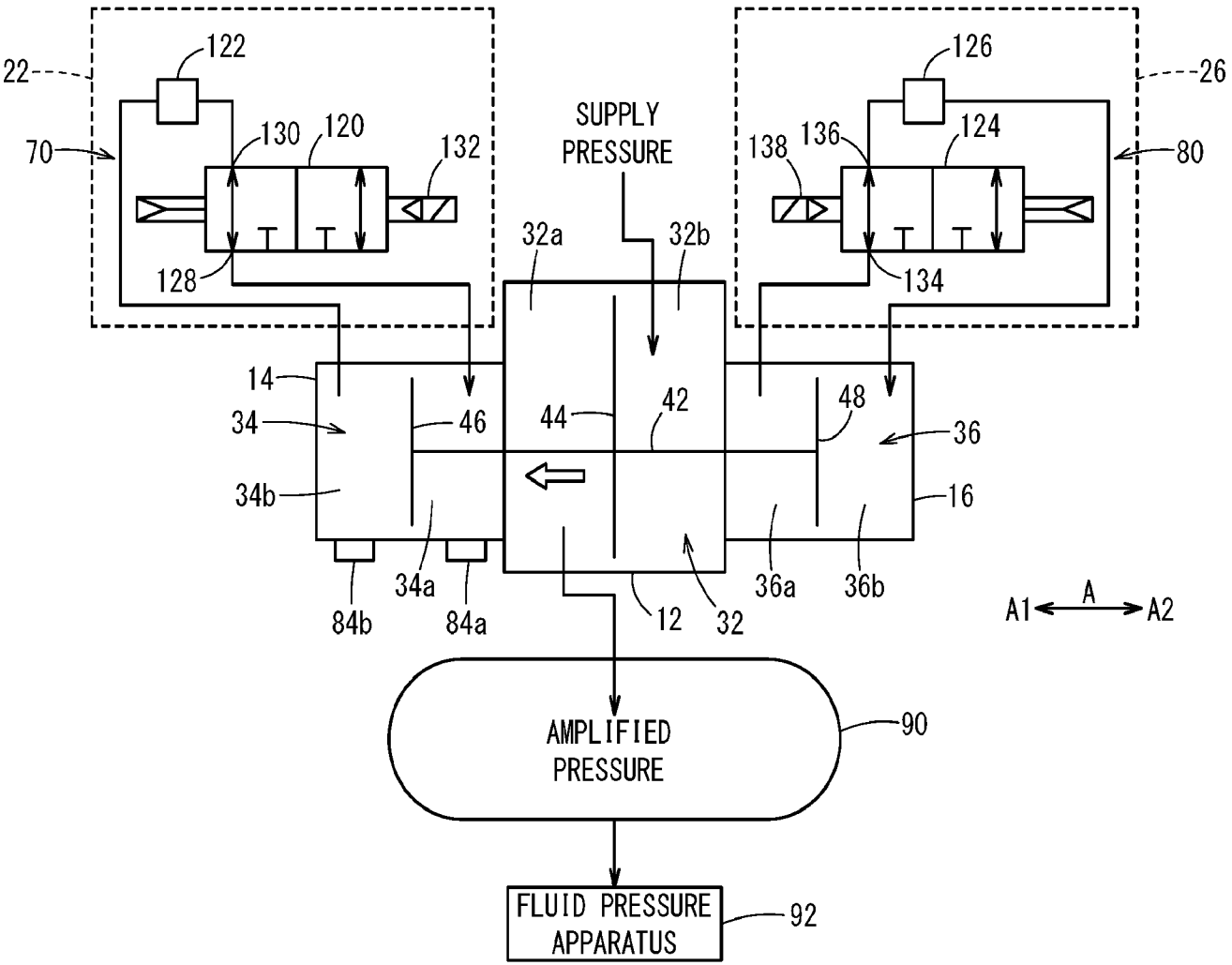
FIG. 14 is an explanatory diagram schematically illustrating the pressure booster according to the first modification.

Next, as shown in FIG. 14, also in the case that the fluid is supplied from the fluid supplying mechanism 52 to the second pressure boosting chamber 32*b* in a state in which the fluid is already supplied to the first pressure boosting chamber 32*a* by the operation of FIG. 13, the PLC 30 stops supplying the control signal to the solenoid 132 via the first connector 24, together with starting to supply the control signal to the solenoid 138 via the second connector 28. Consequently, the solenoid 132 is placed in a demagnetized state (second position), the two connection ports 128 and 130 are connected, and the first pressurizing chamber 34*a* and the second pressurizing chamber 34*b* communicate with each other. Further, the solenoid 138 is placed in a magnetized state (first position), the two connection ports 134 and 136 are connected, and the third pressurizing chamber 36*a* and the fourth pressurizing chamber 36*b* communicate with each other.

As a result, differing from the example of FIG. 13, the fluid in the second pressurizing chamber 34*b* is discharged to the first discharge return flow passage 70, and is supplied to the first pressurizing chamber 34*a* via the first pressure switch 122 and the two connection ports 128 and 130. By the pressure of the fluid supplied to the first pressurizing chamber 34*a*, the first drive piston 46 is pressed toward the second pressurizing chamber 34*b*. Further, the fluid in the third pressurizing chamber 36*a* is discharged to the second discharge return flow passage 80, and is supplied to the fourth pressurizing chamber 36*b* via the two connection ports 134 and 136 and the second pressure switch 126. By the pressure of the fluid supplied to the fourth pressurizing chamber 36*b*, the second drive piston 48 is pressed toward the third pressurizing chamber 36*a*.

Accordingly, in the example of FIG. 14, by supplying the fluid to the second pressure boosting chamber 32*b*, the first pressurizing chamber 34*a*, and the fourth pressurizing chamber 36*b*, the first drive piston 46, the pressure boosting piston 44, the second drive piston 48, and the piston rod 42 are displaced integrally in the A1 direction. Consequently, the fluid inside the first pressure boosting chamber 32*a* is boosted in pressure and discharged to the tank 90.

In this case as well, when the pressure of the fluid flowing through the first discharge return flow passage 70 has decreased to the threshold value, the first pressure switch 122 outputs a pressure signal to the PLC 30 via the first connector 24. Further, when the pressure of the fluid flowing through the second discharge return flow passage 80 has decreased to the threshold value, the second pressure switch 126 outputs a pressure signal to the PLC 30 via the second connector 28. In the case that the respective pressure signals are input thereto from the first pressure switch 122 and the second pressure switch 126, the PLC 30 determines that the first drive piston 46, the pressure boosting piston 44, the second drive piston 48, and the piston rod 42 have been displaced respectively to locations in the vicinity of the end in the A1 direction of the first drive chamber 34, the pressure boosting chamber 32, and the second drive chamber 36, and stops supplying the control signal to the second connector 28, together with starting to supply the control signal from the PLC 30 to the first connector 24. Consequently, the solenoid 132 is placed in a magnetized state (first position), communication between the two connection ports 128 and 130 is interrupted, and the supply of fluid from the second pressurizing chamber 34*b* to the first pressurizing chamber 34*a* is stopped. On the other hand, the solenoid 138 is placed in a demagnetized state (second position), communication between the two connection ports 134 and 136 is interrupted, and the supply of fluid from the third pressurizing chamber 36*a* to the fourth pressurizing chamber 36*b* is stopped.

In addition, with the pressure booster 10A according to the first modification, on the basis of the detection results (pressure signals) of the first pressure switch 122 and the second pressure switch 126, supply of the control signals from the PLC 30 to the solenoids 132 and 138 is switched, thereby causing the first drive piston 46, the pressure boosting piston 44, the second drive piston 48, and the piston rod 42 to undergo reciprocal movement in the A1 direction and the A2 direction, and enabling the pressure boosting operations shown in FIGS. 13 and 14 to be carried out alternately. Consequently, in the pressure booster 10A as well, in the same manner as the pressure booster 10, the pressure value of the fluid supplied from the external fluid supply source can be boosted in pressure to a pressure value up to three times that of the original pressure at a maximum, and the fluid after having been boosted in pressure can be output to the tank 90 through the output port 56, alternately from the first pressure boosting chamber 32*a* and the second pressure boosting chamber 32*b*.

As described above, the pressure booster 10A according to the first modification further includes the first pressure switch 122 and the second pressure switch 126 which detect the pressure of the fluid discharged from one of the pressurizing chambers and supplied to the other pressurizing chamber. Therefore, based on the detection results of the first pressure switch 122 and the second pressure switch 126, the first solenoid valve unit 22 and the second solenoid valve unit 26, respectively, are capable of smoothly performing controls to start supplying or stop supplying the fluid discharged from one of the pressurizing chambers to the other pressurizing chamber. Accordingly, with the pressure booster 10A, similar to the case of using the first position detecting sensor 84*a* and the second position detecting sensor 84*b*, an increase in pressure of the fluid supplied to the first pressure boosting chamber 32*a* and the second pressure boosting chamber 32*b* can be carried out efficiently. It is a matter of course that the first position detecting sensor 84*a* and the second position detecting sensor 84*b* may be additionally provided in the pressure booster 10A, and in addition to the detection results of the first pressure switch 122 and the second pressure switch 126, the PLC 30 may control the first solenoid valve unit 22 and the second solenoid valve unit 26 in consideration of the detection results of the first position detecting sensor 84*a* and the second position detecting sensor 84*b*.

Next, the pressure booster 10B according to the second modification will be described with reference to FIGS. 15 and 16. The pressure booster 10B according to the second modification differs from the pressure boosters 10 and 10A in that, as a third fluid supplying method, when the first solenoid valve unit 22 and the second solenoid valve unit 26 perform the discharge return operation, a portion of the fluid accumulated in one of the pressurizing chambers is supplied to the other pressurizing chamber, together with the other portion thereof being discharged to the exterior, whereby the first drive piston 46, the pressure boosting piston 44, and the second drive piston 48 are made to move in the A directions. Moreover, it should be noted that in the second modification, unlike the pressure booster 10, the operation of supplying the fluid is not carried out on the basis of a difference in the pressure receiving areas.

In order to realize the third fluid supplying method, the pressure booster 10B of the second modification includes the following configuration. More specifically, the first solenoid valve unit 22 is configured to include a four-way five-port seventh solenoid valve 140, a first check valve 142, and a first throttle valve 144. Further, the second solenoid valve unit 26 is configured to include a four-way five-port eighth solenoid valve 146, a second check valve 148, and a second throttle valve 150.

In the first solenoid valve unit 22, the seventh solenoid valve 140 includes a first connection port 152 connected to the first pressurizing chamber 34*a*, a second connection port 154 connected to the second pressurizing chamber 34*b*, a third connection port 156 connected to the second pressurizing chamber 34*b* via the first check valve 142, a fourth connection port 158 connected to the discharge port 68*a* via the first throttle valve 144, a fifth connection port 160 connected to the fluid supplying mechanism 52, and a solenoid 162. The first check valve 142 is disposed midway along the first discharge return flow passage 70, and allows flowing of the fluid from the second pressurizing chamber 34*b* to the first pressurizing chamber 34*a*, while preventing flowing of the fluid from the first pressurizing chamber 34*a* to the second pressurizing chamber 34*b*. The first throttle valve 144 is a variable throttle valve which is capable of adjusting the amount of fluid discharged to the exterior through the discharge port 68*a*.

On the other hand, in the second solenoid valve unit 26, the eighth solenoid valve 146, in the same manner as the seventh solenoid valve 140, includes a first connection port 164 connected to the third pressurizing chamber 36*a*, a second connection port 166 connected to the fourth pressurizing chamber 36*b*, a third connection port 168 connected to the fourth pressurizing chamber 36*b* via the second check valve 148, a fourth connection port 170 connected to the discharge port 68*b* via the second throttle valve 150, a fifth connection port 172 connected to the fluid supplying mechanism 52, and a solenoid 174. The second check valve 148 is disposed midway along the second discharge return flow passage 80, and allows flowing of the fluid from the fourth pressurizing chamber 36*b* to the third pressurizing chamber 36*a*, while preventing flowing of the fluid from the third pressurizing chamber 36*a* to the fourth pressurizing chamber 36*b*. The second throttle valve 150 is a variable throttle valve which is capable of adjusting the amount of fluid discharged to the exterior through the discharge port 68*b*.

Figure 15:
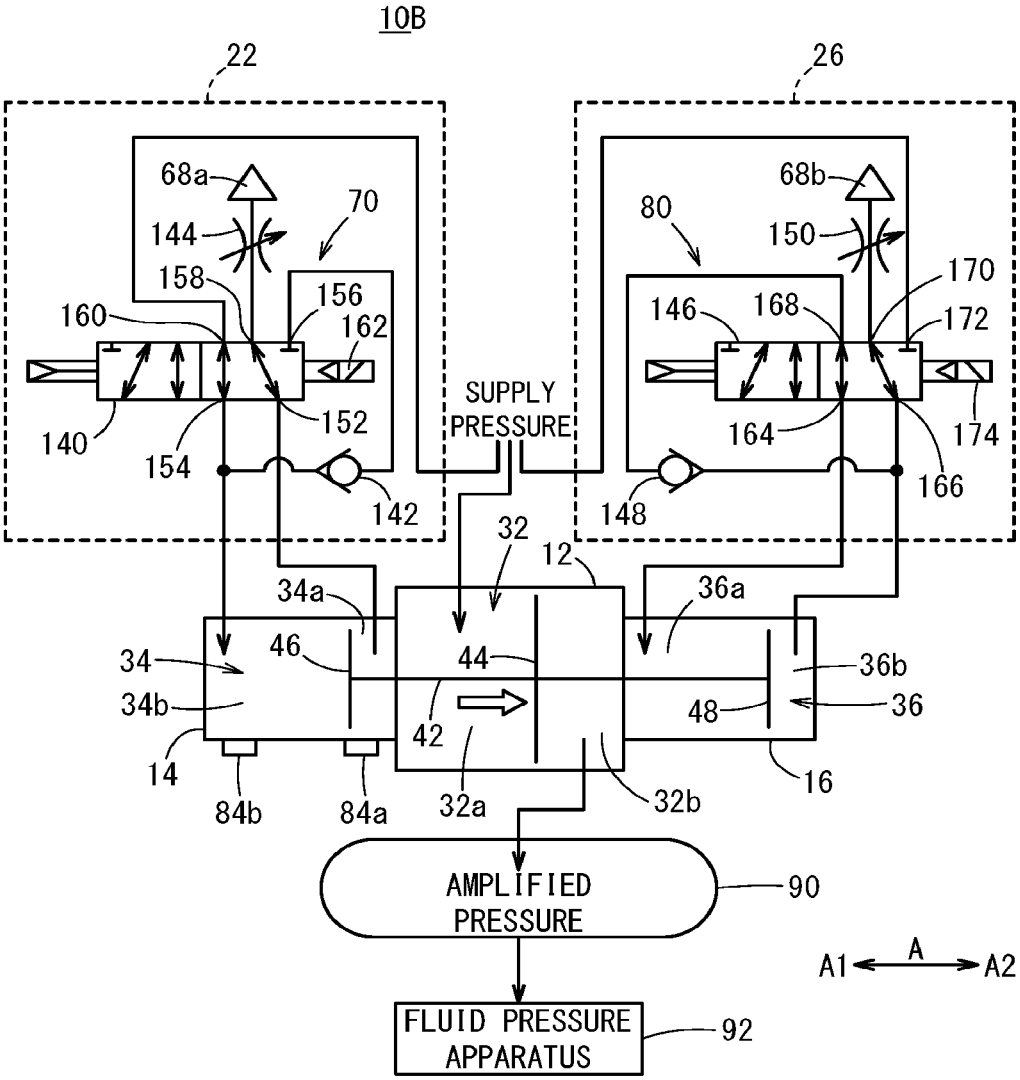
FIG. 15 is an explanatory diagram schematically illustrating a pressure booster according to a second modification.

In addition, according to the second modification, as shown in FIG. 15, in a state in which the fluid is supplied to (accumulated in) the second pressure boosting chamber 32*b*, in the case that the fluid is supplied from the fluid supplying mechanism 52 to the first pressure boosting chamber 32*a*, at first, control signals are supplied from the PLC 30 to the first connector 24 and the second connector 28. Owing thereto, the solenoids 162 and 174 are respectively excited and magnetized (first position). Consequently, by the seventh solenoid valve 140, the first connection port 152 and the fourth connection port 158 are connected, together with the second connection port 154 and the fifth connection port 160 being connected. On the other hand, by the eighth solenoid valve 146, the first connection port 164 and the third connection port 168 are connected, together with the second connection port 166 and the fourth connection port 170 being connected.

As a result, by the first solenoid valve unit 22, the fluid is supplied from the fluid supplying mechanism 52 to the second pressurizing chamber 34*b* via the fifth connection port 160 and the second connection port 154, and together therewith, the fluid is discharged to the exterior from the first pressurizing chamber 34*a* via the first connection port 152, the fourth connection port 158, the first throttle valve 144, and the discharge port 68*a*. Accordingly, by the pressure of the fluid supplied to the second pressurizing chamber 34*b*, the first drive piston 46 is pressed toward the first pressurizing chamber 34*a*.

Further, by the second solenoid valve unit 26, concerning a portion of the fluid from within the fluid discharged from the fourth pressurizing chamber 36*b*, such a portion is supplied to the third pressurizing chamber 36*a* via the second check valve 148 of the second discharge return flow passage 80, the third connection port 168, and the first connection port 164, and concerning the other portion thereof, such a portion is discharged to the exterior via the second connection port 166, the fourth connection port 170, the second throttle valve 150, and the discharge port 68*b*. Consequently, by the pressure of the fluid supplied to the third pressurizing chamber 36*a,* the second drive piston 48 is pressed toward the fourth pressurizing chamber 36*b.*

Accordingly, in the example of FIG. 15, by supplying the fluid to the first pressure boosting chamber 32*a,* the second pressurizing chamber 34*b,* and the third pressurizing chamber 36*a,* the first drive piston 46, the pressure boosting piston 44, the second drive piston 48, and the piston rod 42 are displaced integrally in the A2 direction. Consequently, the fluid inside the second pressure boosting chamber 32*b* is boosted in pressure and discharged to the tank 90.

Moreover, when the pressure of the fluid inside the third pressurizing chamber 36*a* and the pressure of the fluid inside the fourth pressurizing chamber 36*b* become substantially equivalent, by an action of the second check valve 148, supply of the fluid from the fourth pressurizing chamber 36*b* to the third pressurizing chamber 36*a* is stopped. As a result, the fluid inside the fourth pressurizing chamber 36*b* is discharged to the exterior through the second connection port 166, the fourth connection port 170, the second throttle valve 150, and the discharge port 68*b.*

Upon doing so, in the case that the first drive piston 46, the pressure boosting piston 44, the second drive piston 48, and the piston rod 42 are displaced toward the side in the A2 direction, and the fluid is supplied to (accumulated in) the first pressure boosting chamber 32*a,* thereafter, the PLC 30 stops the supply of control signals to the first connector 24 and the second connector 28. Accordingly, the solenoids 162 and 174 are switched respectively to the demagnetized state (the second position shown in FIG. 16). Consequently, by the seventh solenoid valve 140, the first connection port 152 and the third connection port 156 are connected, together with the second connection port 154 and the fourth connection port 158 being connected. On the other hand, by the eighth solenoid valve 146, the first connection port 164 and the fourth connection port 170 are connected, together with the second connection port 166 and the fifth connection port 172 being connected.

As a result, by the first solenoid valve unit 22, concerning a portion of the fluid from within the fluid discharged from the second pressurizing chamber 34*b,* such a portion is supplied to the first pressurizing chamber 34*a* via the first check valve 142 of the first discharge return flow passage 70, the third connection port 156, and the first connection port 152, and concerning the other portion thereof, such a portion is discharged to the exterior via the second connection port 154, the fourth connection port 158, the first throttle valve 144, and the discharge port 68*a.* Consequently, by the pressure of the fluid supplied to the first pressurizing chamber 34*a,* the first drive piston 46 is pressed toward the second pressurizing chamber 34*b.*

Further, by the second solenoid valve unit 26, the fluid is supplied from the fluid supplying mechanism 52 to the fourth pressurizing chamber 36*b* via the fifth connection port 172 and the second connection port 166, and together therewith, the fluid is discharged to the exterior from the third pressurizing chamber 36*a* via the first connection port 164, the fourth connection port 170, the second throttle valve 150, and the discharge port 68*b.* Accordingly, by the pressure of the fluid supplied to the fourth pressurizing chamber 36*b,* the second drive piston 48 is pressed toward the third pressurizing chamber 36*a.*

Figure 16:
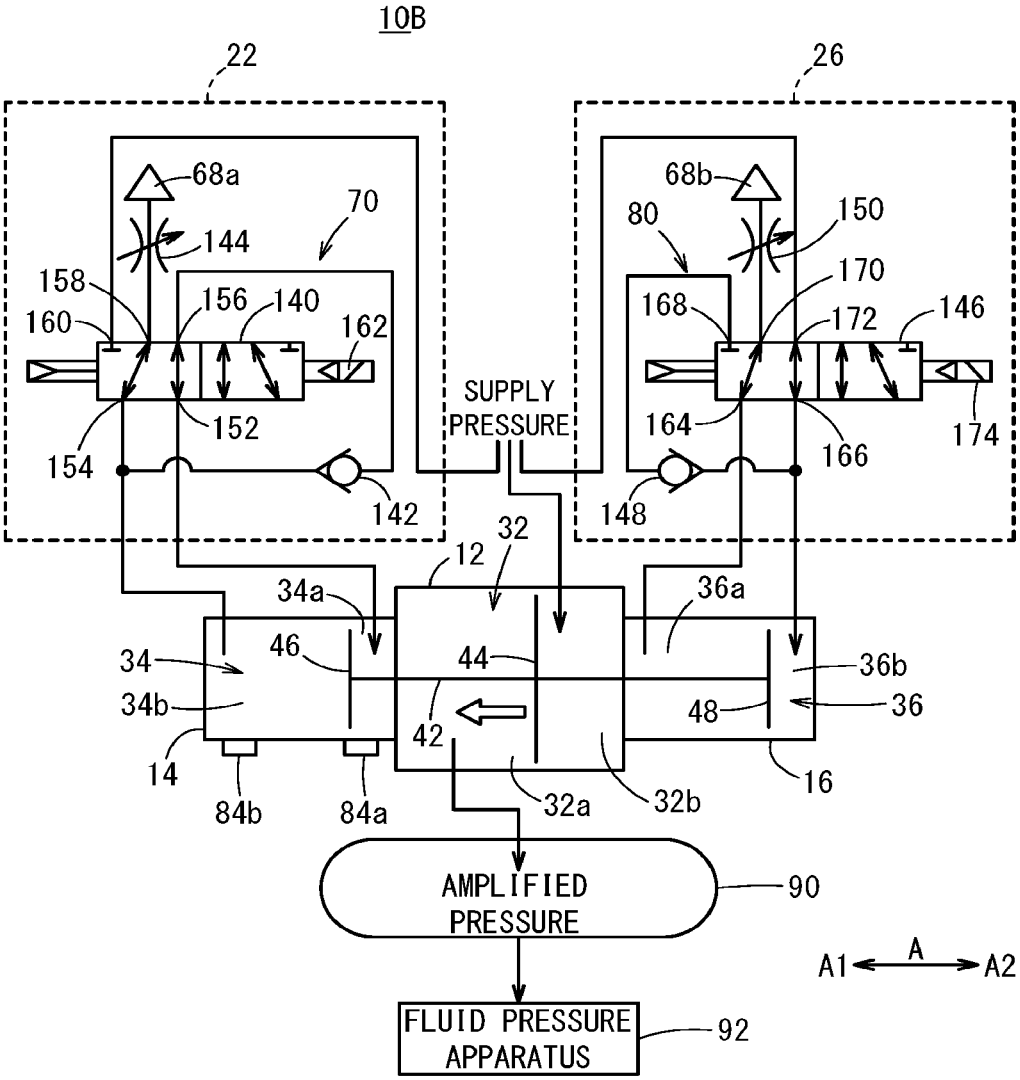
FIG. 16 is an explanatory diagram schematically illustrating the pressure booster according to the second modification.

Accordingly, in the example of FIG. 16, by supplying the fluid to the second pressure boosting chamber 32*b,* the first pressurizing chamber 34*a,* and the fourth pressurizing chamber 36*b,* the first drive piston 46, the pressure boosting piston 44, the second drive piston 48, and the piston rod 42 are displaced integrally in the A1 direction. Consequently, the fluid inside the first pressure boosting chamber 32*a* is boosted in pressure and discharged to the tank 90.

Moreover, when the pressure of the fluid inside the first pressurizing chamber 34*a* and the pressure of the fluid inside the second pressurizing chamber 34*b* become substantially equivalent, by an action of the first check valve 142, supply of the fluid from the second pressurizing chamber 34*b* to the first pressurizing chamber 34*a* is stopped. As a result, the fluid inside the second pressurizing chamber 34*b* is discharged to the exterior through the second connection port 154, the fourth connection port 158, the first throttle valve 144, and the discharge port 68*a.*

In addition, with the pressure booster 10B according to the second modification, by alternately starting and stopping the supply of the control signals from the PLC 30 to the solenoids 162 and 174, the first drive piston 46, the pressure boosting piston 44, the second drive piston 48, and the piston rod 42 are made to undergo reciprocal movement in the A1 direction and the A2 direction, and it is possible for the pressure boosting operations shown in FIGS. 15 and 16 to be carried out alternately. Consequently, in the pressure booster 10B as well, in the same manner as the pressure boosters 10 and 10A, the pressure value of the fluid supplied from the external fluid supply source can be boosted in pressure to a pressure value up to three times that of the original pressure at a maximum, and the fluid after having been boosted in pressure can be output to the tank 90 through the output port 56, alternately from the first pressure boosting chamber 32*a* and the second pressure boosting chamber 32*b.*

In the foregoing manner, with the pressure booster 10B according to the second modification, the fluid that is accumulated in one of the pressurizing chambers is supplied to the other pressurizing chamber together with being discharged to the exterior, and therefore, together with the pressure of the other pressurizing chamber being increased, the pressure of the one pressurizing chamber can be rapidly reduced. Consequently, in addition to the effects of the above-described pressure booster 10, the first drive piston 46, the pressure boosting piston 44, and the second drive piston 48 can be moved smoothly, and an increased service life of the pressure booster 10B can be achieved.

Since the operation of supplying and discharging the fluid, or the operation of supplying the discharged fluid can be reliably and efficiently switched based on the supply of control signals from the PLC 30 to the seventh solenoid valve 140 and the eighth solenoid valve 146, the first drive piston 46, the pressure boosting piston 44, and the second drive piston 48 can be moved smoothly, and it is possible to easily realize a lengthening of the service life of the pressure booster 10B. Further, due to the simple circuit structure including the first check valve 142 and the second check valve 148, it is possible to simplify the configuration of the pressure booster 10B as a whole. The present invention is not limited to the embodiments described above, and various modified or additional structures could be adopted therein without deviating from the scope of the invention as set forth in the appended claims.

The invention claimed is:

1. A pressure booster, comprising:

a pressure boosting chamber;

a first drive chamber disposed on one end side of the pressure boosting chamber;

a second drive chamber disposed on another end side of the pressure boosting chamber;

a piston rod configured to penetrate through the pressure boosting chamber and extend to the first drive chamber and the second drive chamber;

a pressure boosting piston which, by being connected to the piston rod inside the pressure boosting chamber, is configured to partition the pressure boosting chamber into a first pressure boosting chamber on a side of the first drive chamber, and a second pressure boosting chamber on a side of the second drive chamber;

a first drive piston which, by being connected to one end of the piston rod inside the first drive chamber, is configured to partition the first drive chamber into a first pressurizing chamber on a side of the first pressure boosting chamber, and a second pressurizing chamber remote from the first pressure boosting chamber;

a second drive piston which, by being connected to another end of the piston rod inside the second drive chamber, is configured to partition the second drive chamber into a third pressurizing chamber on a side of the second pressure boosting chamber, and a fourth pressurizing chamber remote from the second pressure boosting chamber;

a fluid supplying mechanism configured to supply a fluid to at least one of the first pressure boosting chamber and the second pressure boosting chamber;

a first discharge return mechanism configured to supply the fluid discharged from the first pressurizing chamber to the second pressurizing chamber, or to supply the fluid discharged from the second pressurizing chamber to the first pressurizing chamber; and a second discharge return mechanism configured to supply the fluid discharged from the third pressurizing chamber to the fourth pressurizing chamber, or to supply the fluid discharged from the fourth pressurizing chamber to the third pressurizing chamber.

2. The pressure booster according to claim 1, wherein:

in a case that the fluid is supplied from the fluid supplying mechanism to the first pressure boosting chamber, at least, the first discharge return mechanism supplies the fluid discharged from the first pressurizing chamber to the second pressurizing chamber, or the second discharge return mechanism supplies the fluid discharged from the fourth pressurizing chamber to the third pressurizing chamber;

whereas, in a case that the fluid is supplied from the fluid supplying mechanism to the second pressure boosting chamber, at least, the second discharge return mechanism supplies the fluid discharged from the third pressurizing chamber to the fourth pressurizing chamber, or the first discharge return mechanism supplies the fluid discharged from the second pressurizing chamber to the first pressurizing chamber.

3. The pressure booster according to claim 2, wherein:

in a case that the fluid is supplied from the fluid supplying mechanism to the first pressure boosting chamber, the first discharge return mechanism supplies the fluid discharged from the first pressurizing chamber to the second pressurizing chamber, based on a difference, on the first drive piston, between a pressure receiving area on a side of the first pressurizing chamber and a pressure receiving area on a side of the second pressurizing chamber, and the second discharge return mechanism supplies the fluid to the third pressurizing chamber together with discharging the fluid from the fourth pressurizing chamber;

whereas, in a case that the fluid is supplied from the fluid supplying mechanism to the second pressure boosting chamber, the first discharge return mechanism supplies the fluid to the first pressurizing chamber together with discharging the fluid from the second pressurizing chamber, and the second discharge return mechanism supplies the fluid discharged from the third pressurizing chamber to the fourth pressurizing chamber, based on a difference, on the second drive piston, between a pressure receiving area on a side of the third pressurizing chamber and a pressure receiving area on a side of the fourth pressurizing chamber.

4. The pressure booster according to claim 3, wherein:

the first discharge return mechanism is configured to include a solenoid valve which is configured to supply the fluid supplied from exterior to the fluid supplying mechanism to the first pressurizing chamber together with discharging the fluid of the second pressurizing chamber to the exterior, and on the other hand, is configured to supply the fluid discharged from the first pressurizing chamber to the second pressurizing chamber; and the second discharge return mechanism is configured to include a solenoid valve which is configured to supply the fluid supplied from the exterior to the fluid supplying mechanism to the third pressurizing chamber together with discharging the fluid of the fourth pressurizing chamber to the exterior, and on the other hand, is configured to supply the fluid discharged from the third pressurizing chamber to the fourth pressurizing chamber.

5. The pressure booster according to claim 4, wherein:

the first discharge return mechanism is configured to include a first solenoid valve connected to the first pressurizing chamber, a second solenoid valve connected to the second pressurizing chamber, and a first discharge return flow passage connected with the first solenoid valve and the second solenoid valve;

at a first position of the first solenoid valve and the second solenoid valve, the first pressurizing chamber and the second pressurizing chamber communicate with each other through the first discharge return flow passage;

at a second position of the first solenoid valve and the second solenoid valve, the first pressurizing chamber communicates with the fluid supplying mechanism, and the second pressurizing chamber communicates with the exterior;

the second discharge return mechanism is configured to include a third solenoid valve connected to the third pressurizing chamber, a fourth solenoid valve connected to the fourth pressurizing chamber, and a second discharge return flow passage connected with the third solenoid valve and the fourth solenoid valve;

at a first position of the third solenoid valve and the fourth solenoid valve, the third pressurizing chamber and the fourth pressurizing chamber communicate with each other through the second discharge return flow passage; and at a second position of the third solenoid valve and the fourth solenoid valve, the third pressurizing chamber communicates with the fluid supplying mechanism, and the fourth pressurizing chamber communicates with the exterior.

6. The pressure booster according to claim 2, wherein:

in a case that the fluid is supplied from the fluid supplying mechanism to the first pressure boosting chamber, the first discharge return mechanism supplies the fluid discharged from the first pressurizing chamber to the second pressurizing chamber, together with the second discharge return mechanism supplying the fluid discharged from the fourth pressurizing chamber to the third pressurizing chamber;

whereas, in a case that the fluid is supplied from the fluid supplying mechanism to the second pressure boosting chamber, the first discharge return mechanism supplies the fluid discharged from the second pressurizing chamber to the first pressurizing chamber, together with the second discharge return mechanism supplying the fluid discharged from the third pressurizing chamber to the fourth pressurizing chamber.

7. The pressure booster according to claim 6, wherein:

the first discharge return mechanism is configured to include a three-way valve type fifth solenoid valve which, in a first position, is configured to interrupt communication between the first pressurizing chamber and the second pressurizing chamber, whereas in a second position, is configured to allow communication between the first pressurizing chamber and the second pressurizing chamber;

the fifth solenoid valve, by switching between a communication interrupted state and a communication allowed state, carries out supply of the fluid discharged from the first pressurizing chamber to the second pressurizing chamber, or carries out supply of the fluid discharged from the second pressurizing chamber to the first pressurizing chamber;

the second discharge return mechanism is configured to include a three-way valve type sixth solenoid valve which, in a first position, is configured to allow communication between the third pressurizing chamber and the fourth pressurizing chamber, whereas in a second position, is configured to interrupt communication between the third pressurizing chamber and the fourth pressurizing chamber; and the sixth solenoid valve, by switching between a communication interrupted state and a communication allowed state, carries out supply of the fluid discharged from the third pressurizing chamber to the fourth pressurizing chamber, or carries out supply of the fluid discharged from the fourth pressurizing chamber to the third pressurizing chamber.

8. The pressure booster according to claim 2, wherein:

in a case that the fluid is supplied from the fluid supplying mechanism to the first pressure boosting chamber, the first discharge return mechanism discharges the fluid from the first pressurizing chamber together with supplying the fluid to the second pressurizing chamber, and the second discharge return mechanism, while supplying a portion of the fluid discharged from the fourth pressurizing chamber to the third pressurizing chamber, discharges another portion of the fluid to exterior;

whereas, in a case that the fluid is supplied from the fluid supplying mechanism to the second pressure boosting chamber, the first discharge return mechanism, while supplying a portion of the fluid discharged from the second pressurizing chamber to the first pressurizing chamber, discharges another portion of the fluid to the exterior, and the second discharge return mechanism discharges the fluid from the third pressurizing chamber together with supplying the fluid to the fourth pressurizing chamber.

9. The pressure booster according to claim 8, wherein:

the first discharge return mechanism is configured to include a seventh solenoid valve which is configured to supply the fluid supplied from the exterior to the fluid supplying mechanism to the second pressurizing chamber together with discharging the fluid of the first pressurizing chamber to the exterior, and on the other hand, while supplying a portion of the fluid discharged from the second pressurizing chamber to the first pressurizing chamber, is configured to discharge another portion of the fluid to the exterior; and the second discharge return mechanism is configured to include an eighth solenoid valve which is configured to supply the fluid supplied from the exterior to the fluid supplying mechanism to the fourth pressurizing chamber together with discharging the fluid of the third pressurizing chamber to the exterior, and on the other hand, while supplying a portion of the fluid discharged from the fourth pressurizing chamber to the third pressurizing chamber, is configured to discharge another portion of the fluid to the exterior.

10. The pressure booster according to claim 9, wherein:

the first discharge return mechanism is configured to include the seventh solenoid valve of a four-way five-port solenoid valve, and a first check valve;

the seventh solenoid valve, in a first position, places the first pressurizing chamber in communication with the exterior together with placing the second pressurizing chamber in communication with the fluid supplying mechanism, whereas in a second position, places the second pressurizing chamber in communication with the exterior and in communication with the first pressurizing chamber via the first check valve;

the second discharge return mechanism is configured to include the eighth solenoid valve of a four-way five-port solenoid valve, and a second check valve;

the eighth solenoid valve, in a first position, places the fourth pressurizing chamber in communication with the exterior and in communication with the third pressurizing chamber via the second check valve, whereas in a second position, places the third pressurizing chamber in communication with the exterior together with placing the fourth pressurizing chamber in communication with the fluid supplying mechanism.

11. The pressure booster according to claim 1, further comprising:

a position detecting sensor configured to detect a position of the first drive piston or the second drive piston;

wherein, based on a detection result of the position detecting sensor, the first discharge return mechanism and the second discharge return mechanism, respectively, carry out supply of the fluid discharged from one of the pressurizing chambers to another pressurizing chamber.

12. The pressure booster according to claim 11, wherein the position detecting sensor comprises a first position detecting sensor configured to detect arrival of the first drive piston or the second drive piston at one end side of the first drive chamber or the second drive chamber, and a second position detecting sensor configured to detect arrival of the first drive piston or the second drive piston at another end side of the first drive chamber or the second drive chamber.

13. The pressure booster according to claim 11, wherein the position detecting sensor comprises a magnetic sensor configured to detect the position of the first drive piston or the second drive piston by detecting magnetism produced by a magnet attached to the first drive piston or the second drive piston.

14. The pressure booster according to claim 1, further comprising:

a pressure sensor configured to detect a pressure of the fluid discharged from one of the pressurizing chambers and supplied to another pressurizing chamber;

wherein, based on a detection result of the pressure sensor, the first discharge return mechanism and the second discharge return mechanism, respectively, stop supplying the fluid discharged from the one of the pressurizing chambers to the other pressurizing chamber.

15. The pressure booster according to claim 1, wherein the fluid supplying mechanism is configured to include a check valve configured to prevent back-flowing of the fluid from the first pressure boosting chamber and the second pressure boosting chamber.

16. The pressure booster according to claim 15, further comprising:

a fluid output mechanism configured to output to exterior the fluid that was boosted in pressure in the first pressure boosting chamber or the second pressure boosting chamber;

wherein the fluid output mechanism is configured to include a check valve configured to prevent back-flowing of the fluid into the first pressure boosting chamber and the second pressure boosting chamber.

17. The pressure booster according to claim 1, wherein a size of the first drive chamber in a diametrical direction thereof and a size of the second drive chamber in a diametrical direction thereof are smaller than a size of the pressure boosting chamber in a diametrical direction thereof.

18. The pressure booster according to claim 1, wherein:

a first cover member is interposed between the first pressure boosting chamber and the first pressurizing chamber;

a second cover member is interposed between the second pressure boosting chamber and the third pressurizing chamber;

a third cover member is disposed on an end of the second pressurizing chamber remote from the first cover member;

a fourth cover member is disposed on an end of the fourth pressurizing chamber remote from the second cover member;

the first drive piston is displaced inside the first drive chamber without coming into contact with the first cover member and the third cover member;

the second drive piston is displaced inside the second drive chamber without coming into contact with the second cover member and the fourth cover member; and the pressure boosting piston is displaced inside the pressure boosting chamber without coming into contact with the first cover member and the second cover member.

* * * * *